US011013312B2

(12) United States Patent
Staniszewski et al.

(10) Patent No.: US 11,013,312 B2
(45) Date of Patent: May 25, 2021

(54) COLLAPSIBLE HANDLE FOR A TOOL

(71) Applicant: Springfield Innovation Group LLC, Springfield, PA (US)

(72) Inventors: Megan Staniszewski, Havertown, PA (US); Mia Dutton, Folsom, PA (US)

(73) Assignee: Springfield Innovation Group LLC

( * ) Notice: Subject to any disclaimer, the term of this patent is extended or adjusted under 35 U.S.C. 154(b) by 184 days.

(21) Appl. No.: 16/279,255

(22) Filed: Feb. 19, 2019

(65) Prior Publication Data

US 2019/0254411 A1 Aug. 22, 2019

Related U.S. Application Data

(60) Provisional application No. 62/632,130, filed on Feb. 19, 2018.

(51) Int. Cl.
*A46B 5/00* (2006.01)

(52) U.S. Cl.
CPC ..... *A46B 5/0041* (2013.01); *A46B 5/0095* (2013.01); *A46B 2200/302* (2013.01); *Y10T 16/473* (2015.01)

(58) Field of Classification Search
CPC ..... A46B 5/0041; A46B 5/0095; A46B 2200/302; B25G 3/38; B25G 1/04;
(Continued)

(56) References Cited

U.S. PATENT DOCUMENTS 1,039,986 A * 10/1912 Merritt ..... 403/61
1,906,218 A * 4/1933 Patchell ..... B25G 3/02 403/100

(Continued)

FOREIGN PATENT DOCUMENTS

AU 2006252097 1/2012
CH 176776 6/1934

(Continued)

OTHER PUBLICATIONS

International Search Report and Written Opinion from PCT/US2019/018555 dated Apr. 26, 2019, pp. 1-13.

(Continued)

*Primary Examiner* — William L Miller
(74) *Attorney, Agent, or Firm* — The Belles Group, P.C.

(57) ABSTRACT

A foldable handle for long-handled tools includes first and second handle members hingedly coupled together at their respective coupling ends by a toggle linkage. The linkage is pivotably coupled to each of the handle members via first and second pivot pins respectively forming a double-jointed articulating joint. The joint includes multiple locking features which cooperate to form a rigid and anti-rotational joint when the handle members are in a coaxially-aligned operational unfolded condition. The linkage includes oppositely extending arm portions slideably insertable into complementary configured locking axial passages in the hinge members. Each handle member includes a plurality of mutually interlocking axial protrusions. The linkage includes a block-shaped middle portion between the arms which lockingly engage a transverse channel in each end of the handle members. Finally, a slideable collar covers the joint and threadably engages one of the handle member to conceal and secure the joint.

21 Claims, 25 Drawing Sheets

(58) Field of Classification Search
CPC .... F16C 11/10; Y10T 16/473; Y10T 16/5404; E04H 15/48; E05D 11/1007
USPC ..... 16/429, 343; 15/146, 144.1, 144.3; 403/102; 135/143
See application file for complete search history.

(56) References Cited

U.S. PATENT DOCUMENTS

| | | | | |
|---|---|---|---|---|
| 3,380,097 | A | 4/1968 | Pharris | |
| 3,778,610 | A | 12/1973 | Wolf | |
| 4,131,378 | A | 12/1978 | Daws | |
| 4,611,945 | A | 9/1986 | Diego | |
| 4,929,113 | A | 5/1990 | Sheu | |
| 5,178,583 | A | 1/1993 | Rankin | |
| 5,217,315 | A | 6/1993 | Rosane | |
| 5,417,511 | A | 5/1995 | Warden | |
| D375,451 | S | 11/1996 | Ohkubo | |
| 5,746,533 | A | 5/1998 | Schmidt | |
| 5,887,314 | A | 3/1999 | Jordan, Jr. | |
| 6,371,873 | B1 * | 4/2002 | Wang | A63B 63/004 273/407 |
| 6,532,630 | B1 | 3/2003 | Newman et al. | |
| 6,546,596 | B2 | 4/2003 | Grote et al. | |
| 6,675,546 | B2 | 1/2004 | Coles | |
| 6,711,783 | B2 | 3/2004 | LeMole | |
| 6,776,499 | B2 | 8/2004 | Chang | |
| 7,003,849 | B2 | 2/2006 | Cohen | |
| 7,356,871 | B2 | 4/2008 | Heaven | |
| 7,549,194 | B2 | 6/2009 | Vosbikian et al. | |
| 7,673,365 | B1 | 3/2010 | Griffin, Sr. | |
| 7,677,619 | B2 | 3/2010 | Hutchings et al. | |
| D660,535 | S | 5/2012 | Menius | |
| D667,598 | S | 9/2012 | Menius | |
| 8,566,999 | B1 | 10/2013 | Casey | |
| D699,412 | S | 2/2014 | Smith | |
| D714,613 | S | 10/2014 | Jenkins | |
| D719,712 | S | 12/2014 | Widmer et al. | |
| D782,273 | S | 3/2017 | Cramer-Kelly | |
| 9,915,081 | B2 * | 3/2018 | Sosnowski | E04H 15/48 |
| D825,306 | S | 8/2018 | Stinson | |
| 10,076,221 | B2 | 9/2018 | Cook | |
| D834,915 | S | 12/2018 | Boyce et al. | |
| 10,633,885 | B2 * | 4/2020 | Sosnowski | A45B 19/08 |
| 10,641,319 | B2 * | 5/2020 | Chen | A63B 63/00 |
| 2013/0291893 | A1 | 11/2013 | Stokes | |
| 2017/0282348 | A1 | 10/2017 | Mark | |

FOREIGN PATENT DOCUMENTS

| | | |
|---|---|---|
| CN | 2610836 | 4/2004 |
| CN | 2850504 | 12/2006 |
| CN | 202355361 | 11/2011 |
| CN | 2066151385 | 6/2016 |
| CN | 106725148 | 5/2017 |
| EP | 1572422 | 9/2003 |
| FR | 2523501 | 3/1982 |
| WO | WO 2018/154107 A1 | 8/2018 |

OTHER PUBLICATIONS

"Xifando Three-Section Telescopic Aluminum Alloy Rod Long Handled Broom", www.amazon.com, Jan. 10, 2019, pp. 1-3.
"Cassabella 86012 Height Adjustable Duster Broom with Dustpan", www.amazon.com, Jan. 10, 2019, pp. 1-5.

* cited by examiner

COLLAPSIBLE HANDLE FOR A TOOL

CROSS-REFERENCE TO RELATED APPLICATIONS

The present application claims the benefit of U.S. Provisional Application No. 62/632,130 filed Feb. 19, 2018; the entirety of which is incorporated herein by reference.

BACKGROUND

The present invention generally relates to tools having long handles, such as without limitation implements such as brooms, mops, or others as some examples.

Conventional push brooms, dust brooms, mops, and other household cleaning or other implements have long handles that typically end in a threaded cap that can be screwed into a mop head or brush head having an internally threaded hole for receiving the handle. The purpose of the handle is to enable the user to use the implement comfortably, but at the same time, the handle causes the implement to take up a lot of space.

The problem associated with the length of conventional handles manifests itself in various ways. The shipping of brooms from the manufacturer or distribution center to a retail store where they will be sold, or to a purchaser is cumbersome and unduly expensive in comparison to the value of the item because the implements take up so much shipping space and are awkward to stack or otherwise bundle conveniently for shipment. Likewise, implements with long handles are difficult to store in small spaces such as janitorial closets, the work vehicles of tradesmen and tradeswomen, or in other places. Long conventional handles also present problems in terms of placement on store shelves where space is well-known to be at a premium.

Handles that slide into one another, or "telescope," have been used to provide collapsibility for some implements, but they are not ideally suited for the application of axial forces such that which occurs when using a broom, mop, or other tool or implement. Such telescope handles generally tend to break prematurely or collapse unexpectedly when in use. Moreover, these types of handles require some sections to have a smaller diameter than others, which unacceptably reduces strength and rigidity. Another problem with telescoping handles is that foreign particles or liquids can find their way into the telescoping portions and can interfere with proper operation to collapse or extend the handle. Still another problem is that the internal mechanism that permits the telescoping action can break, which renders the handle to about half the size it needs to be for comfortable operation.

Although some cleaning implements are shipped for convenience with separate handle segments that must be assembly by the end user, such constructions cannot readily be broken back down easily or conveniently once assembled and therefore do not offer a usable solution.

What is needed is an implement that has an elongated handle that can easily be broken down for storage or shipment so that it takes up much less space, maintain a mechanical coupling between segments of the handle when collapsed, and still be very sturdy and dependable.

SUMMARY OF THE INVENTION

A tool with foldable tool handle according to the present disclosure provides a hinge mechanism comprising a double-jointed articulating hinged joint. The hinge mechanism generally comprises four active hinge components in one embodiment, which are configured to cooperate for creating a rigid and torque resistant coupling between pivotably connected first and second handle sections or members. The use of multiple springs or fasteners is not required, thereby providing a mechanical simple and reliable constructions without need for use of multiple springs or fasteners. The handle is changeable via operation of a toggle linkage which couples first and second handle members together between (i) an unfolded condition in which first and second handle members pivotably coupled together by the hinged joint are coaxially aligned with a longitudinal axis of the handle, and (ii) a folded condition in which the second handle member movable to a position laterally offset from the longitudinal axis in side-by-side relationship to the first handle member for compactly shipping or storing the tool. In some non-limiting embodiments, the tool may be a maintenance tool such as broom or mop. Other type tools may use the articulating joint.

The hinge mechanism includes a multitude of different locking features and actions which collectively form a mechanically interlocked joint when the first handle member is coaxially aligned and coupled to the second handle member with the handle assembly in the straight operational unfolded configuration or condition. The multiple locking feature act in concert to form an axially rigid handle assembly which resists twisting and torsional forces acting about the joint around the longitudinal axis when the tool is in use. Such robust joints thus have many practical uses and applications, only one of which is described herein as an example.

In one aspect, a foldable elongated tool handle for compact storage of a tool comprises: a longitudinal axis; an elongated first handle member comprising a terminal end configured for coupling to a tool, and a coupling end; an elongated second handle member comprising a coupling end; the coupling ends of the first and second handle members hingedly coupled together at a first articulated joint via an elongated toggle linkage; the toggle linkage having a rigid body comprising a first arm portion opposite a second arm portion, and a central middle portion therebetween; the first arm portion of the toggle linkage slideably insertable into a first central axial passage in the coupling end of the first hinge member, and the second arm portion of the toggle slideably insertable into a second central axial passage in the coupling end of the second handle member; the handle changeable via operation of the toggle linkage between (i) an unfolded condition in which the first and second handle members are coaxially aligned with the longitudinal axis, and (ii) a folded condition in which the second handle member is laterally offset from the longitudinal axis in side-by-side relationship to the first handle member.

In another aspect, a foldable tool handle with articulating joint comprises: a longitudinal axis; an elongated first handle member comprising first and second ends; an elongated second handle member comprising first and second ends; the first handle member hingedly coupled to the second handle member by a double-jointed articulating joint; the articulating joint comprising a first coupler fitting attached to the first end of the first handle section, a second coupler fitting attached to the first end of the second handle section, and a toggle linkage; the toggle linkage comprising an elongated body including a first arm portion opposite a second arm portion, and a central middle portion located therebetween; the toggle linkage pivotably coupled to: (i) the first coupler fitting via a first pivot pin slideably received in an elongated slot of the first arm portion, and (ii) the second coupler fitting via second pivot pin slideably received in an elongated slot of the second arm portion; the handle changeable via operation of the toggle linkage between (i) an unfolded condition in which the first and second handle members are coaxially aligned with the longitudinal axis, and (ii) a folded condition in which the second handle member is laterally offset from the longitudinal axis in side-by-side relationship to the first handle member via sliding the pivot pins in their respective slots.

In another aspect, a method for operating a tool having a foldable elongated tool handle comprises: providing a tool handle comprising an elongated first handle member in a folded configuration axially offset from a second handle member, the handle members hingedly coupled together at their respective coupling ends by a toggle linkage, the toggle linkage pivotably coupled to the first handle member via a first pivot pin, and the toggle linkage pivotably coupled to the second handle member via a second pivot pin forming a double-jointed articulating joint; rotating the first handle member about the joint into coaxial alignment to the second handle member; inserting a first arm portion of the toggle linkage into a first axial passage of the coupling end of the first hinge member, the first arm portion having a rectilinear cross-sectional shape which locking engages a complementary configured cross-sectional shape of the first axial passage; inserting a second arm portion of the toggle linkage into a second axial passage of the coupling end of the second hinge member, the second arm portion having a rectilinear cross-sectional shape which locking engages a complementary configured cross-sectional shape of the second axial passage; and inserting a first plurality of axial protrusions at the coupling end of the first handle member between a second plurality of axial protrusion at the coupling end of the second handle member to form an interlocked arrangement; wherein the first handle member coupled to the second handle member in coaxial alignment defines an unfolded configuration.

BRIEF DESCRIPTION OF THE DRAWINGS

The features of the exemplary embodiments will be described with reference to the following drawings where like elements are labeled similarly, and in which.

Figure 1:
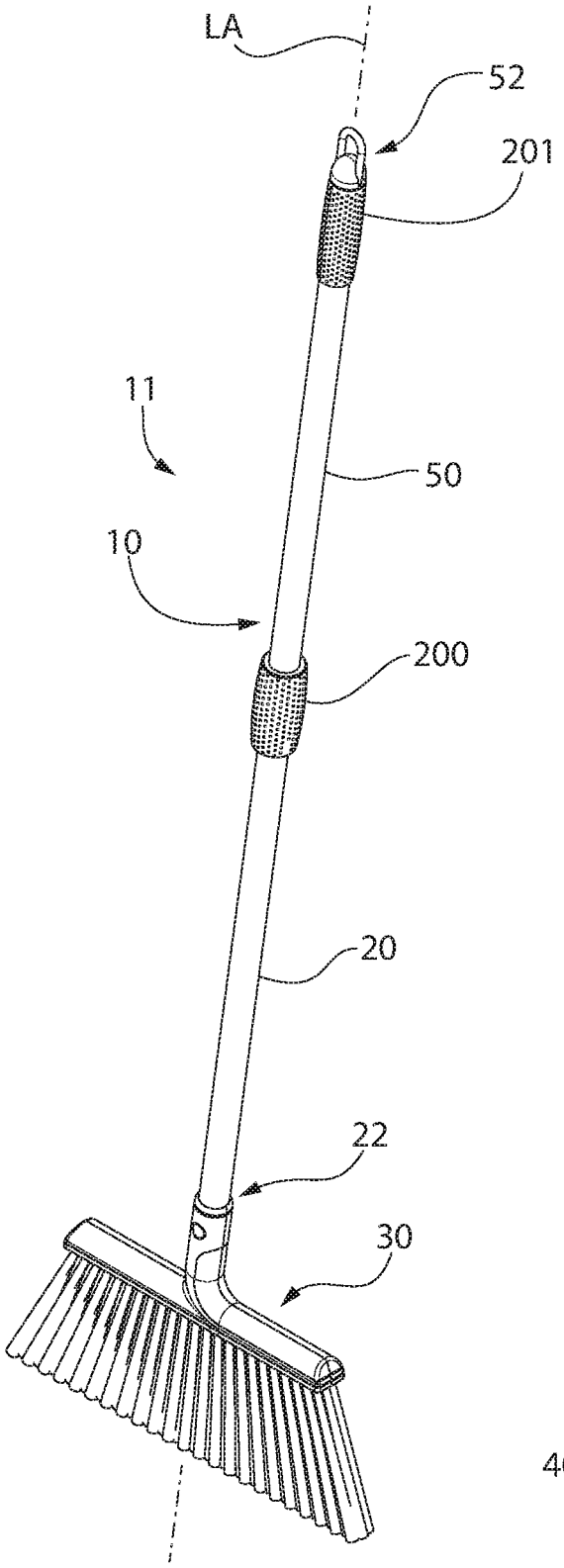
FIG. 1 is a perspective view of a long-handled tool comprising a collapsible tool handle shown in an axially straight unfolded operational configuration or condition, constructed in accordance with an embodiment of the present invention.
Figure 2:
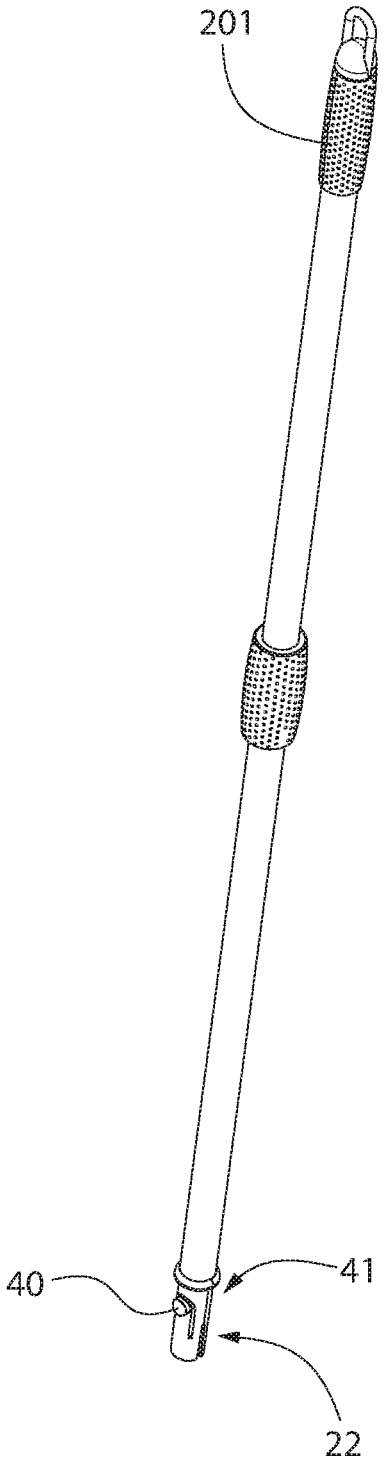
FIG. 2 is a perspective side view thereof showing only the handle.

All drawings are schematic and not necessarily to scale. Parts shown and/or given a reference numerical designation in one figure may be considered to be the same parts where they appear in other figures without a numerical designation for brevity unless specifically labeled with a different part number and described herein.

DETAILED DESCRIPTION OF EMBODIMENTS

The features and benefits of the invention are illustrated and described herein by reference to preferred but non-limiting exemplary ("example") embodiments. This description of the embodiments is intended to be read in connection with the accompanying drawings, which are to be considered part of the entire written description. Accordingly, the invention expressly should not be limited to such embodiments illustrating some possible non-limiting combination of features that may exist alone or in other combinations of features; the scope of the invention being defined by the claims appended hereto.

In the following description, for purposes of explanation, numerous specific details are set forth in order to provide a thorough understanding of example embodiments. It will be evident to one skilled in the art, however, that embodiments can be practiced without these specific details, or with various combinations of these details.

In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise.

With initial reference to FIGS. 1-14, one non-limiting embodiment of a long-handed tool 11 with collapsible handle according to the present disclosure is illustrated for creating a compact tool configuration for shipment, storage, packaging, and/or display. Tool 11 includes a collapsible and jointed elongated handle assembly 10 (or variously "handle" 10 for brevity) defining a proximal end 52 closest to a user, a distal end 22, and longitudinal axis LA extending therebetween. Distal end 22 is configured for mounting an implement 30 thereto, such as broom or other implement as further described herein. Distal end 22 of the tool handle 10 may rigidly coupled to implement 30 as shown, or alternatively rotatably/pivotably coupled to the implement in other embodiments.

The collapsible handle 10 includes elongated lower handle member 20 and elongated upper handle member 50 pivotably and hingedly coupled together by a hinge mechanism 60 comprising an articulated joint 61. In one embodiment, the hinge mechanism 60 is configured so that the upper handle member 50 is rotatable at least 180 degrees relative to the lower handle member 20 to place the handle 10 in a collapsed folded configuration for shipment, storage, packaging, and/or display. This rotation is illustrated by a comparison for example of FIGS. 12 and 13. Furthermore, the hinge mechanism 60 is configured such that the lower and upper handle members are not only pivotably coupled together, but the upper handle member 50 may be displaced to a position laterally offset and parallel to the lower handle member 20 in a stowed and collapsed folded configuration or condition, while concurrently still maintaining the physical coupling between the handle members as further described herein.

Handle members 20, 50 may each have an elongated cylindrical body in one implementation. However, any suitable configuration and structure may be used. In one embodiment, as illustrated, handle members 20, 50 may each have hollow tubular construction for weight reduction. In other embodiments, portions of or the entire handle members may have a generally solid cross section. Handle members 20, 50 as depicted are cylindrical and have a circular transverse cross-sectional shape. In other embodiments, the handle members may have other configurations and solid or hollow cross-sectional shapes such as polygonal (e.g. hexagonal, octagonal, triangular, etc.), rectilinear (e.g. square or rectangular), a combination thereof, or other. Accordingly, the shape and structure of the handle members does not limit the invention.

In certain embodiments, the hinge mechanism 60 comprises an upper hinge member such as coupler fitting 70 fixedly coupled to distal end 58 of the upper handle member 50 opposite its proximal end 52, and a lower hinge member such as coupler fitting 80 fixedly coupled to proximal end 28 of the lower handle member 20 opposite its distal end 22.

Hinge coupler fittings 70, 80 each have a generally cylindrical body with various features formed therein as described below. The fittings each have a first mounting end 71, 81 fixedly coupled to the ends of the upper and lower handle members 50, 20 at joint 61, and an opposite second coupling end 72, 82 configured for forming an interlocked arrangement between the fittings and toggle linkage 100 when the handle 10 is in the fully coupled and coaxially aligned operational configuration or condition. In one embodiment, the mounting ends 71, 81 may have a cylindrical configuration of smaller diameter than the exposed main body of the fittings 70, 80. Mounting ends 71, 81 have a diameter slightly smaller diameter than the inside diameter of the open ends of handle members 20, 50 to which the coupler fittings 70, 80 are attached. This allows the cylindrical mounting ends 71, 81 to slide inside the handle members. The coupler fittings 70, 80 may be rigidly and fixedly coupled to the handle members 50, 20 at their mounting ends 71, 81 by any suitable means, such as for example without limitation fasteners, crimping, pins, welding, soldering, brazing, industrial adhesives, threaded coupling, interlock couplings, combinations thereof, or other methods.

The coupling ends 72, 82 have a castellated configuration each comprising a plurality of lockable axial fingers or protrusions 110 that extend axially parallel to the longitudinal axis LA away from the ends of their respective handle members 50, 20. The locations of the axial protrusions 110 of the upper hinge coupler fitting 70 on upper handle 50 are the inverse of the locations of the axial protrusions 110 of the lower hinge coupler fitting 80 on lower handle member 20 so that they interlock when the handle 10 is placed in operational configuration, as further described herein.

Each set of axially-extending protrusions 110 includes a spaced apart pair of first axial protrusions 110-1 on a first side of the coupler fittings 70, 80, and an axially-extending single second axial locking protrusion 110-2 on a second diametrically opposite side of the coupler fittings. The first axial protrusions 110-1 may be have the same shape, but may be oriented so that they are arranged as a mirror image of each other (see, e.g. FIG. 7). An axially (upwardly) and laterally inwards and outwards open locking receptacle 110-3 is defined between the pair of first axial protrusions 110-1 on coupler fitting 70. The second axial locking protrusions 110-2 are arranged diametrically opposite to the locking receptacle 110-3 on each coupler fitting. Receptacle 110-3 of coupler fitting insertably receives the single second axial locking protrusion 110-2 of the other coupler fitting 80 when the handle 10 is in the straight operational configuration or condition in which each handle member 20, 50 is coaxially aligned with the longitudinal axis. Similarly, an axially and laterally open locking receptacle 110-3 is defined between the pair of first axial protrusions 110-1 on coupler fitting 80 which insertably receives the single axial locking protrusion 110-2 of the other coupler fitting 20 when the handle 10 is in the operational position. The mating sets of receptacles 110-3 and second locking protrusions 110-2 form a meshed and interlocked relationship to lock the coupler fittings 70, 80 together forming a rigid assemblage.

To enhance the rigidity of the connection between the coupler fittings 70, 80, the second axial locking protrusions 110-2 and their respective locking receptacles 110-3 preferably have a rectilinear complementary configuration in transverse cross-sectional shape. FIGS. 25-40 shown the coupler fittings 70 and 80 in isolation and detail. With additional reference to these figures, the second axial locking protrusions 110-2 may have a three-dimensional substantially rectilinear configuration such as a rectangular cuboid (i.e. right rectangular prism) or square cuboid (right square prism). The term "substantially" connotes that some or all of the corners of the axial locking protrusions may be slightly chamfered or rounded to conform to the circular transverse cross-sectional shape of the coupler fittings and handle members, and to facilitate inserting the axial locking protrusions 110-2 into the locking receptacles 110-3. In one embodiment, the second protrusions 110-2 and locking receptacles 110-3 thus each have a rectilinear cross-sectional shape (e.g. square or rectangular) which when interlocked, advantageously resists twisting of the coupler fittings 70, 80 (and their attached pole members 50, 20) about the longitudinal axis LA.

The interlocked pairs of axial locking protrusions 110-2 and receptacles 110-3 define a first locking feature of the hinged joint 61. Axial locking protrusions 110-2 define a pair of planar bearing surfaces 111 facing in opposite directions on opposite sides of the axial locking protrusions. Bearing surfaces 111 abuttingly engage a mating pair of opposing planar bearing surfaces 112 formed on opposing sides of the locking receptacle 110-3. The interface between bearing surfaces 111 and 112 is one of flat-to-flat. Bearing surfaces 112 may be formed by inward facing sides of each first axial protrusion 110-1 (see also FIG. 7). The axial locking protrusions 110-2 and receptacles 110-3 are preferably dimensioned so that a snug frictional fit is formed therebetween when the axial locking protrusions are inserted into their respective receptacles. This enhances creation of a tight and rigid joint.

The axially extending first axial protrusions 110-1 may have a substantially triangular prismatic shape. The term "substantially" connotes that some or all of the corners and outward facing side surface of the first axial protrusions may be slightly chamfered or rounded to conform to the circular transverse cross-sectional shape of the coupler fittings and handle members, and to facilitate inserting the axial locking protrusions 110-2 into the locking receptacles 110-3. In one embodiment, the outward facing side surface of each first axial protrusion 110-1 may be arcuately convexly curved (see, e.g. FIGS. 7, 8, and 32).

It bears noting that other suitable shapes and configurations of the first axial protrusions 110-1 and second axial locking protrusions 110-2 may be used in other possible embodiments and does not limit the invention.

Referring generally to FIGS. 7, 8, and 25-40, a laterally extending elongated locking channel 113 is formed between the first axial protrusions 110-1 and second axial locking protrusion 110-2 of each coupler fitting 70, 80. Channel 113 extends below the axial protrusions 110-1, 110-2 towards the mounting ends 71, 81 of the coupler fittings 70, 80. Channel 113 extends laterally and diametrically from side-to-side of the coupler fittings, and perpendicularly intersects the longitudinal axis LA of the handle 10 at the centerline of the handle members 20, 50. Channel 113 is defined by two opposing and parallel sidewalls 116 which extend transversely across the coupler fittings 70, 80. The locking channel 113 further defines first lower and inboard planar surface 114 forming a bottom wall of the channel. Surface 114 is oriented perpendicularly to longitudinal axis LA. A second upper and outward planar surface 115 is defined by the coupler fittings 70. 80 at opposite sides of the fitting above the locking channel 113. Upper surface 115 is oriented parallel to lower surface 114 and perpendicularly to longitudinal axis LA. The axially extending protrusions 110 of each coupler fitting 70, 80 originate at upper surface 115 and extend upwards therefrom (see, e.g. FIGS. 7 and 8).

Figure 4:
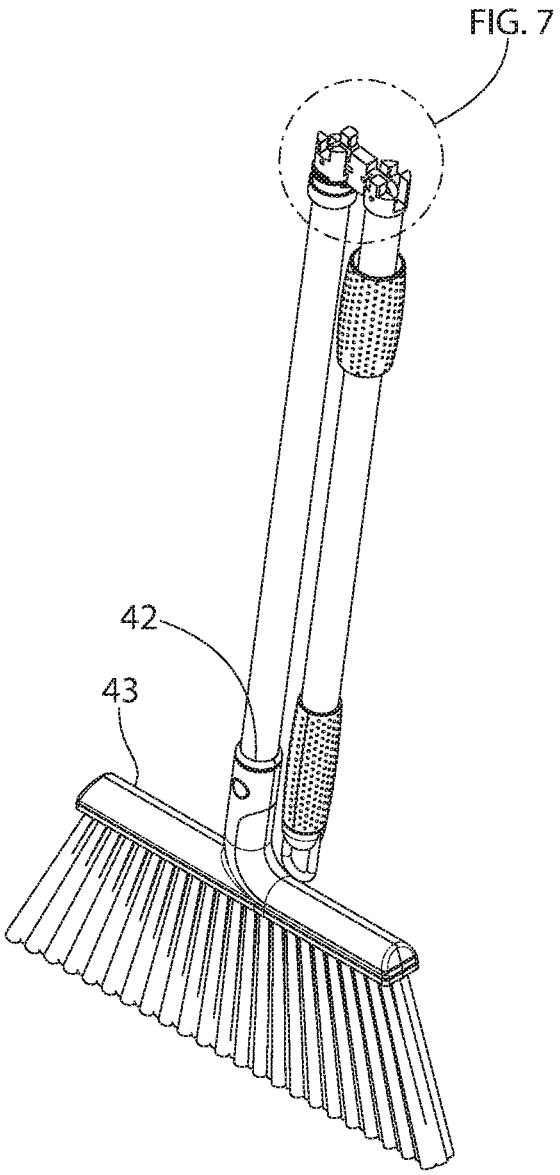
FIG. 4 is a perspective view showing the tool handle in a folded storage configuration or condition.
Figure 5:
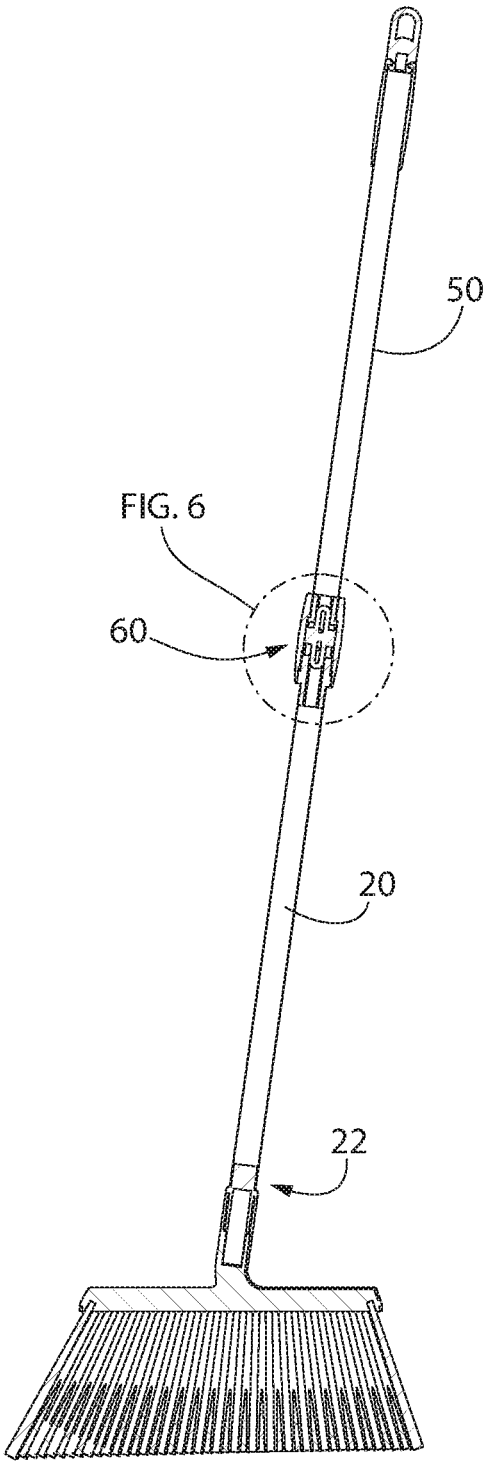
FIG. 5 is a cross-sectional side view of the tool.
Figure 6:
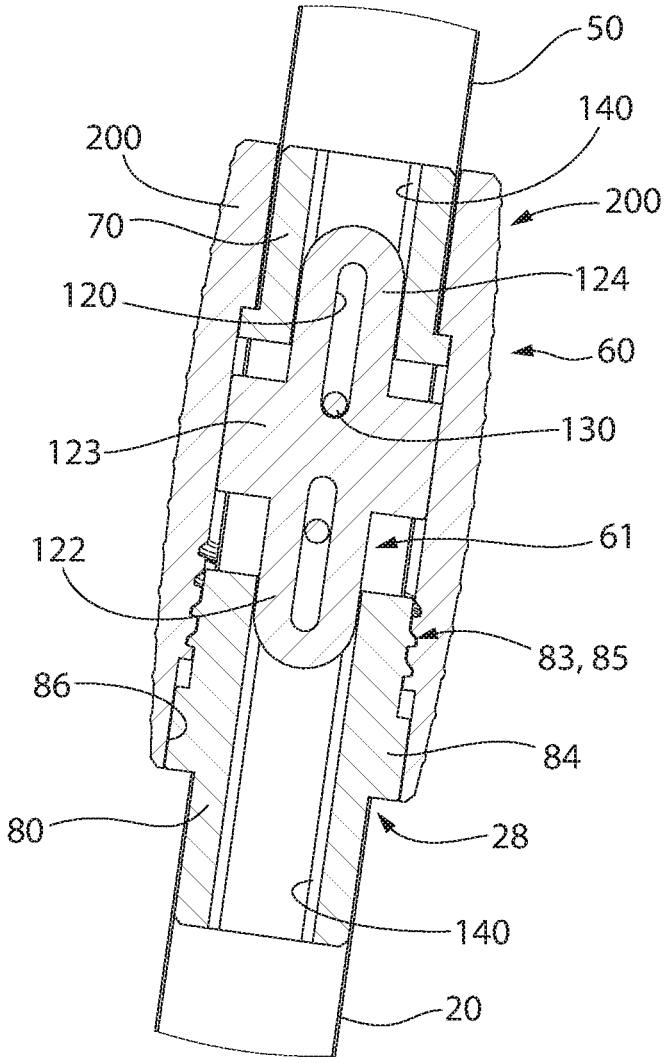
FIG. 6 is an enlarged cross-sectional detail of the hinged joint taken from FIG. 5.
Figure 7:
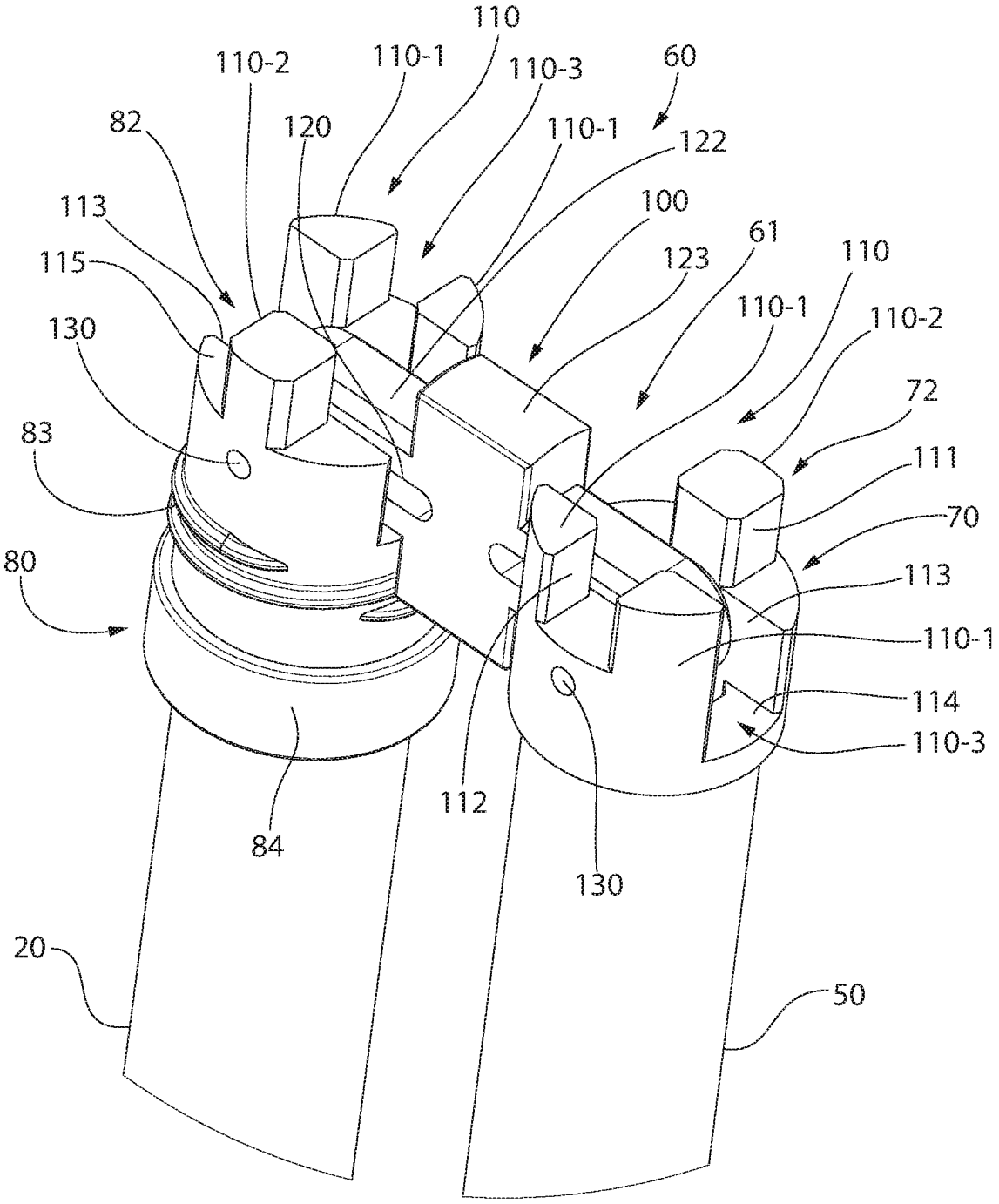
FIG. 7 is enlarged perspective view of the hinged joint showing the collapsible handle in the folded configuration or condition.
Figure 8:
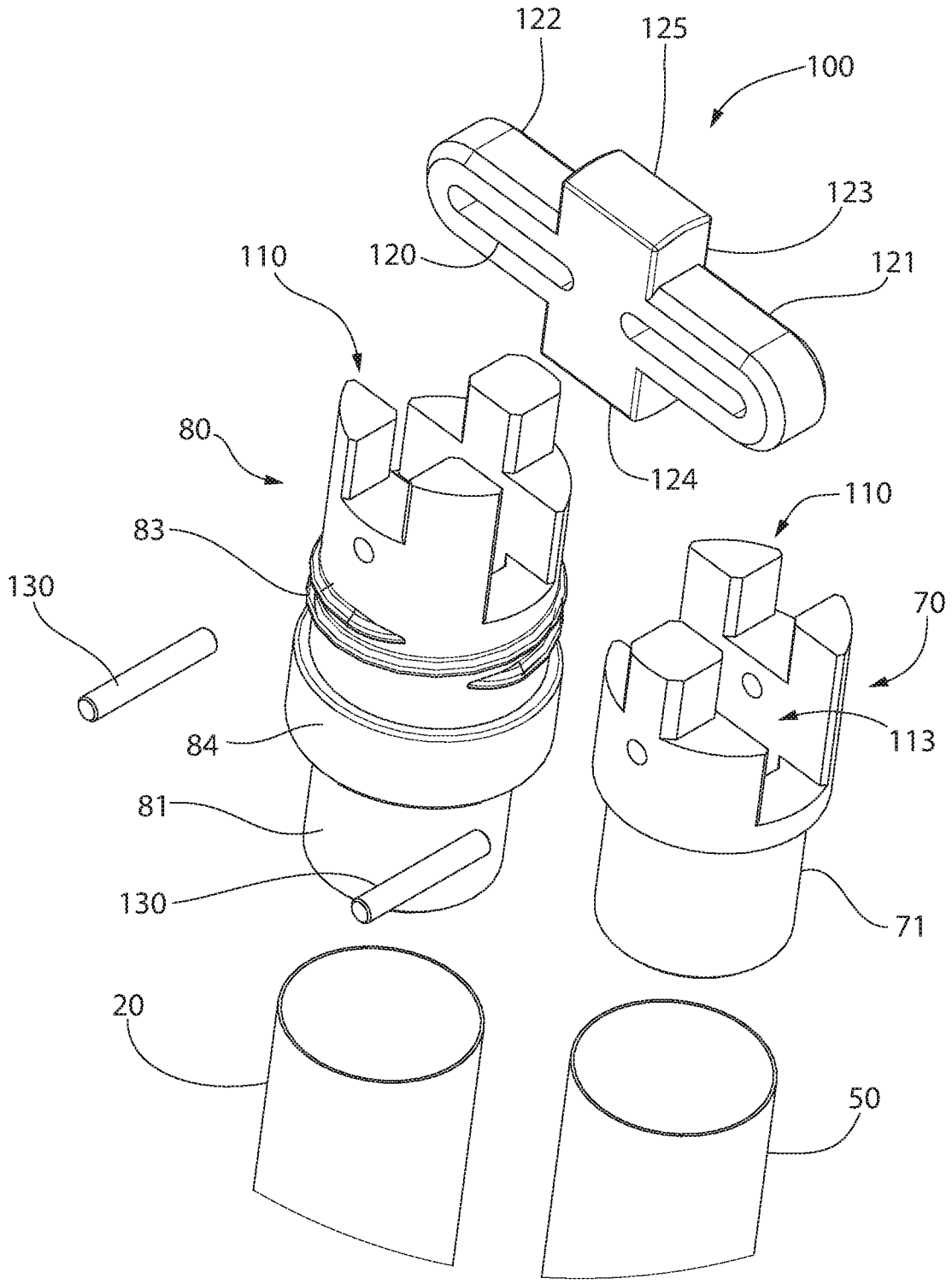
FIG. 8 is an exploded view thereof.
Figure 9:
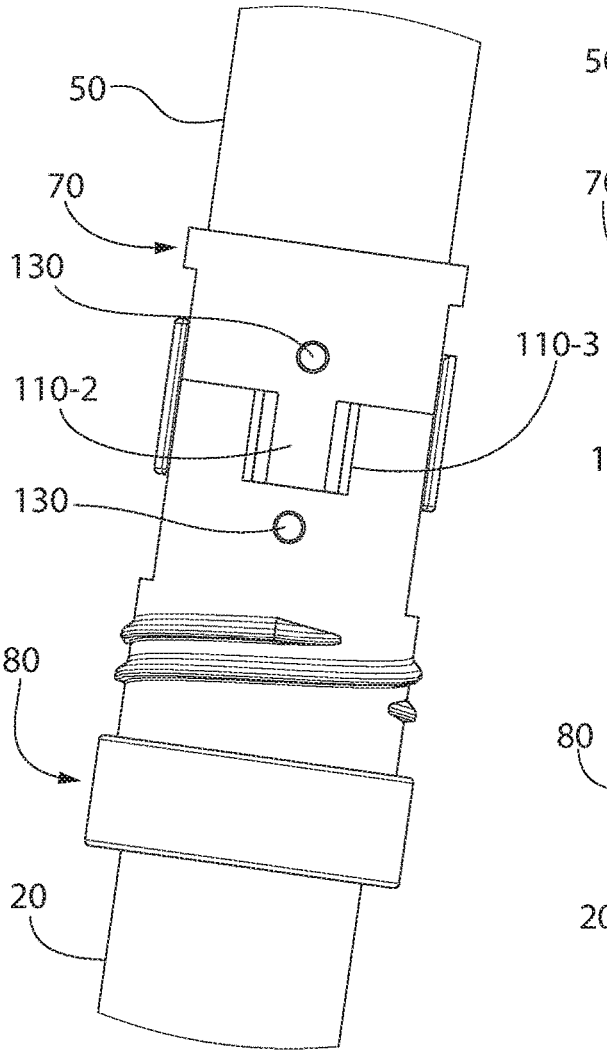
FIG. 9 is a first side view of the hinged joint in an axially coupled position.
Figure 10:
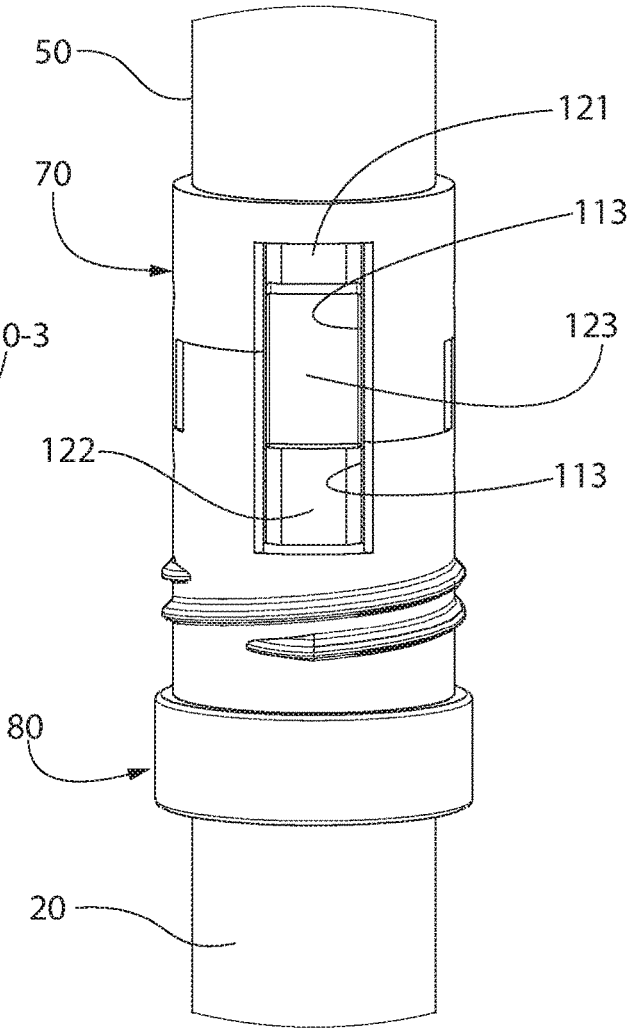
FIG. 10 is a second side view thereof from a different angle 90 degrees from the view shown in FIG. 9.

Mounted channel 113 receives and lockingly engages an elongated toggle linkage 100 (further described herein) when the tool 11 is in the stowed configuration or condition (see, e.g. FIGS. 4 and 7). This helps maintain the tool in the folded condition.

In one embodiment, each coupler fitting 70, 80 comprising the foregoing features is formed as a monolithic unitary structure. The coupler fittings may be formed of a single injection molded polymeric body in one construction.

The hinge coupler fittings 70, 80 are pivotably and hingedly connected together by toggle linkage 100 in one embodiment. FIGS. 41-44 show toggle linkage 100 in isolation and detail. Referring to these figures and FIGS. 7-11, toggle linkage has an elongated rigid body comprising an elongated first arm portion 121 opposite an elongated second arm portion 122, and an elongated rectilinear block-shaped central or middle portion 123 formed therebetween. Thought of another way, the arm portions 121, 122 may also be considered as extending in opposite directions from the block-shaped middle portion. A centerline CL is defined as extending between opposing ends 129 of the body; each end 129 being defined by one of the arm portions 121, 122. The arm portions 121, 122 extend parallel to and along the centerline CL. The elongated block-shaped middle portion 123 is oriented transversely to the centerline CL and arm portions. Toggle linkage 100 may thus be considered as having generally cruciform in overall configuration which is symmetrical about centerline CL.

Middle portion 123 defines an integral opposing pair of locking block protrusions 124, 125 each of which project laterally outwards in opposite directions of the toggle linkage body from the centerline CL. The locking block protrusions 124, 125 may therefore extend outwards farther from centerline CL of toggle linkage 100 than the opposing lateral sides 128 of arm portions 121, 122 as shown. The block-shaped middle portion 1223 and each of its locking block protrusion 124, 125 has a generally rectangular or square cuboid configuration with a rectilinear transverse cross-sectional shape.

To couple the coupler fitting 70 to coupler fitting 80, a pair of elongated captive slots 120 are formed in toggle linkage 100. The slots 120 are oriented parallel to and intersect the centerline CL of the toggle linkage body. One slot 120 is formed in each arm portion 121, 122 of toggle linkage 100 on opposite sides of the block-shaped middle portion 123. Pivot pins 130 pass transversely through the hinge couplers 70, 80, and also pass through the slots 120 in toggle linkage 100 to translationally capture the linkage. This enables the hinge couplers 70, 80 to be pulled far enough away from each other such that the axial protrusions 110 no longer interlock, thereby allowing the handle members 20, 50 and coupler fittings 70, 80 to be rotated relative to each other while still being connected via the linkage 100. The elongated slots 120 allow the handle members 20, 50 to assume a laterally offset and side-by-side relationship to each other (see, e.g. FIGS. 4, 7, and 13).

The foregoing term "captive" is used to connote that the slots 120 have closed ends and sides being completely contained with the confines the of toggle linkage body. Slots 120 therefore do not extend through the lateral sides 128 or ends 129 of the arm portions 121, 122. Each slot does however extend completely through opposing and parallel major front and rear surfaces 126, 127 of the toggle linkage 100 as shown. Pivot pins 130 that pass through the hinge couplers 70, 80, also pass through the linkage 100 and translationally capture the linkage 100 whereby the linkage 100 enables the hinge couplers 70, 80 to be pulled far enough away from each other that the fingers no longer interlock and the members can be rotated relative to each other while still being connected via the linkage 100.

It bears noting that the two slots 120 and corresponding pivot pins 130 form a double-jointed hinge mechanism 60 because each handle member 20 and 50 is independently rotatable about their respective pivot pin in toggle linkage 100, and toggle linkage is rotatable about each pivot pin. Furthermore, the slot and pin arrangement allows the pin 130 to slide along the arm portions 121, 122 of toggle linkage 100 so that the handle members can be laterally displaced and translated relative to each. The present double-jointed hinge mechanism 60 contrasts to other folding long-handled tools having a single pivot which do not permit forming the laterally offset and side-by-side relationship between the upper and lower handle members 50, 20 shown for example in FIGS. 4, 7, and 13.

Referring to FIGS. 6, 8, and 25-40, each coupler fitting 70, 80 includes an elongated central axial through passage 140 which extends along and coaxial with the longitudinal axis LA of the handle 10. Passages 140 pass completely through the mounting portions 71, 81 of the fittings at one end and penetrate through the body of the fitting to the open transverse channels 113 formed in the coupling ends 72, 82 of the fittings at the other end. The passages 140 are therefore in communication with the channels 113. Each passage may extend axially for about one-half or more of the length of the coupler fittings 70, 80 in certain embodiments, and are therefore distinguishable from simply short holes in an object. The arm portions 121, 122 of toggle linkage 100 are insertable into a respective one of the axial passages 140 when the handle 10 is in the straight operations configuration or condition. This forms an interlocked arrangement between the linkage 100 and walls of each of the passages 140 (see, e.g. FIG. 6). This defines a second locking feature of hinge mechanism 60 that contributes to the rigid and robust coupling between the handle members 20, 50, thereby advantageously resisting twisting or torsional forces imparted to the hinged joint 61 when the tool 11 is in use.

To enhance the rigidity of the connection between the coupler fittings 70, 80 and the toggle linkage arm portions 121, 122, the central axial passages 140 and their respective arm portions preferably have a rectilinear complementary configuration in transverse cross-sectional shape. The cross-sectional shape of the arm portions 121, 122 and passages 140 may be rectangular or square in some embodiments. Each central axial passage 140 defines a plurality of inward facing planar bearing surfaces 141 (e.g. 2 pairs of orthogonal parallel surfaces) which engage the outer mating planar surfaces of each linkage arm portion 121, 122 defined by the pair of lateral sides 128 and major front and rear surfaces 126, 127 of the toggle linkage 100. The linkage arm portions 121, 122 slideably engage the bearing surfaces 141 when inserted into axial passages 140 from the lateral channels 113 of the coupler fittings 70, 80. Once located, the planar bearing surfaces 141 engage the mating outer surfaces of toggle linkage arm portions 121, 122 via a flat-to-flat interface to resist twisting or torsional forces impacts by the handle when in use.

To further enhance the rigidity of the connection between the coupler fittings 70, 80 and the toggle linkage arm portions 121, 122, the central axial passages 140 may each have an axial length at least equal to or greater than an axial length of their respective first and second arm portions 121, 122 of the toggle linkage 100 in some embodiments.

The block-shaped middle portion 123 of toggle linkage 100 with its locking block protrusions 124, 145 define a third locking feature of the hinged joint 61, which contributes to forming a rigid and anti-rotational coupling between the coupler fittings 70, 80 and handle portions 20, 50 of the handle 10. When the handle members 20 and 50 are laterally offset from each arranged in a side-by-side relationship shown in FIG. 7 (with the handle 10 in the folded configuration or condition), the toggle linkage 100 is oriented horizontally (assuming the handle members are oriented vertically). In this position, the block-shaped middle portion 123 of toggle linkage 100 is located between the coupler fittings 70, 80 and handle members 20, 50 as shown.

To change the handle 10 to the axially aligned operational unfolded configuration or condition shown in FIG. 1, the toggle linkage 100 is rotated about each pivot pin 130 to coaxially align the centerline CL of the linkage with longitudinal axis LA.

When the hinge couplers 70,80 are interlocked in the operational configuration or condition, the handle members 20, 50 are substantially coaxial and hinge mechanism 60 resists rotational forces and twisting of the handle members relative to each other about the longitudinal axis LA. When the hinge couplers 70, 80 are separated and pulled as far apart from each other as the pivot 130 pins captured in the slots 120 will allow, the upper handle member 50 may be rotated 180 degrees to place the handle 10 in collapsed or folded configuration or condition for storage, packaging, and/or shipping. In this condition, the toggle linkage 100 may be horizontally and transversely oriented (i.e. perpendicularly or obliquely) relative to the handle members 20, 50. Block-shaped middle portion 123 of toggle linkage 100 is located between the coupler fittings 70, 80 and handle members at the joint 61 (see, e.g. FIG. 7)

In certain embodiments, the handle 10 is further stabilized in the axially-aligned operational unfolded configuration by a joint locking sleeve or collar 200. In an embodiment, referring to FIGS. 6 and 11, the locking collar 200 may have a hollow tubular construction (e.g. cylindrical) and slideably mounted on the upper handle member 50. Collar 200 is movable to cover and conceal the articulated joint 61 (see, e.g. FIG. 1). After the handle assembly 10 is placed in operational unfolded configuration or condition, the locking collar 200 is slid down over the joint 61 and hinge mechanism 60 to provide further stabilization of the interlocked upper and lower handle members 50, 20. In certain embodiments, the lower coupler fitting 80 contains external threads 83 that are mated to internal threads 85 formed on the inside lower portion of the locking collar 200 inside its central passage, whereby the collar may be screwed onto the hinge mechanism 60 to threadably engage the lower handle member 20 vis-à-vis coupler fitting 80.

Figure 11:
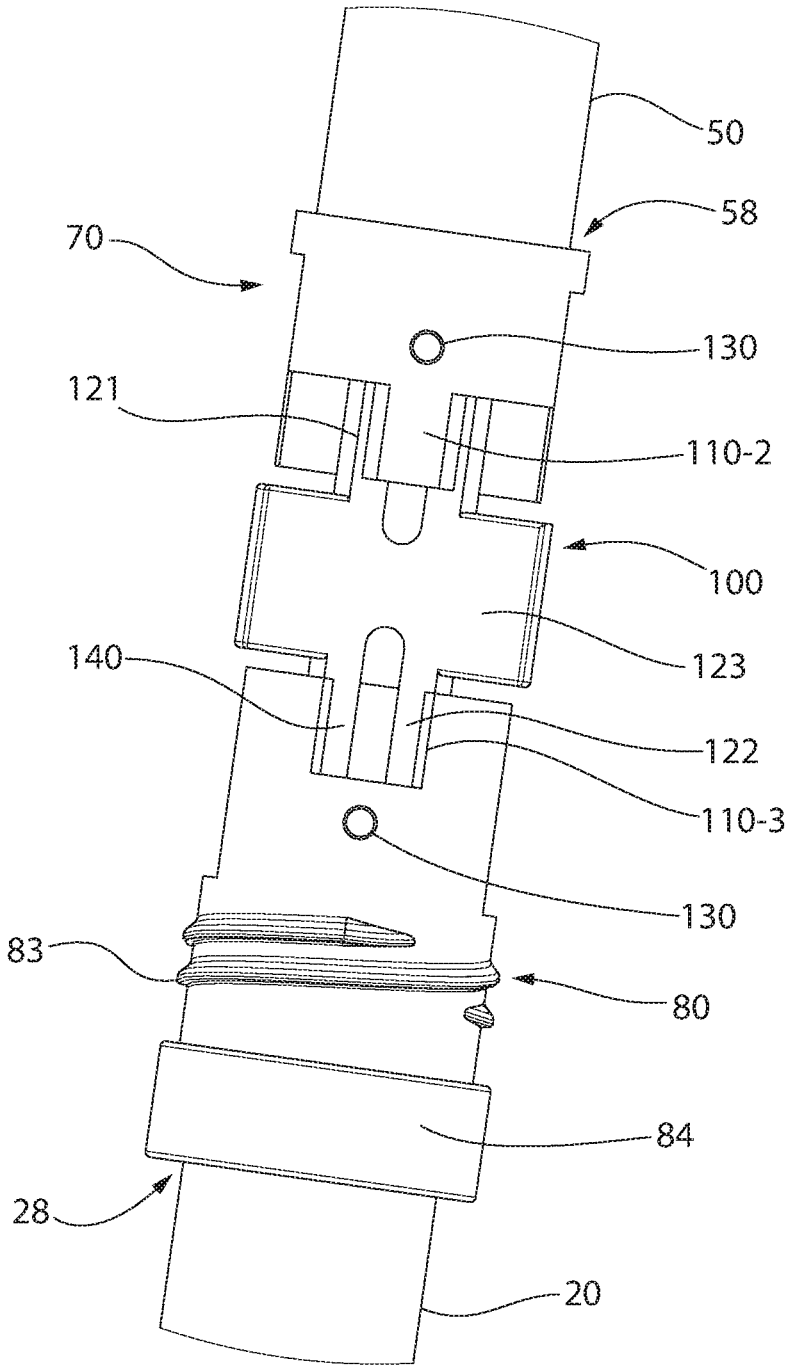
FIG. 11 is the side view of FIG. 9 showing the hinged joint in a partially open position.
Figure 14:
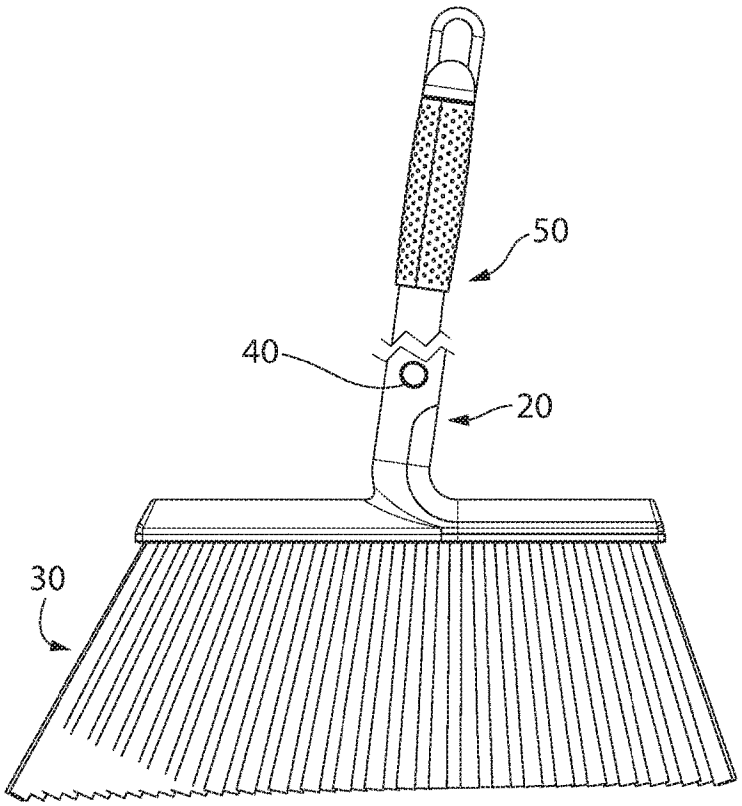
FIG. 14 is an enlarged view of the implement coupled to the handle.

In some embodiments, the lower coupler fitting 80 may include an annular and laterally protruding locking flange 84 located immediately below and adjacent to threads 83 (see, e.g. FIG. 11). Flange 84 frictionally engages an internal annular bearing surface 86 formed inside the lower portion of locking collar 200 when the collar threadably engages the lower coupler fitting 80. In one embodiment, annular flange 84 may have a frustoconical shaped outer surface in side profile to increase frictional engagement flange with the locking collar 200 when the collar is tightened. Threading the collar 200 onto the lower coupler fitting 80 gradually increases engagement to the frustoconical surface until the collar can no longer be advanced downwards and is snuggly engaged with the annular flange.

Figure 3:
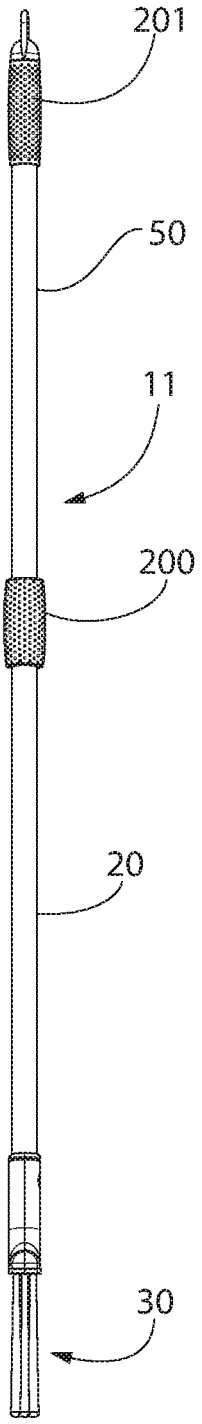
FIG. 3 is a side view thereof showing the handle from a different angle.
Figure 13:
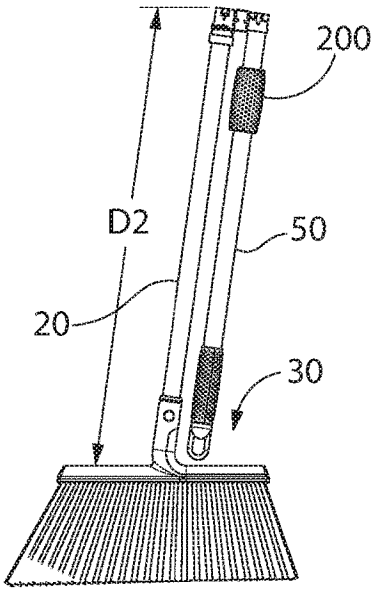
FIG. 13 shows the tool handle in the folded configuration or condition in which a first handle section is laterally offset and parallel to a first handle section coupled to an implement of the tool.
Figure 12:
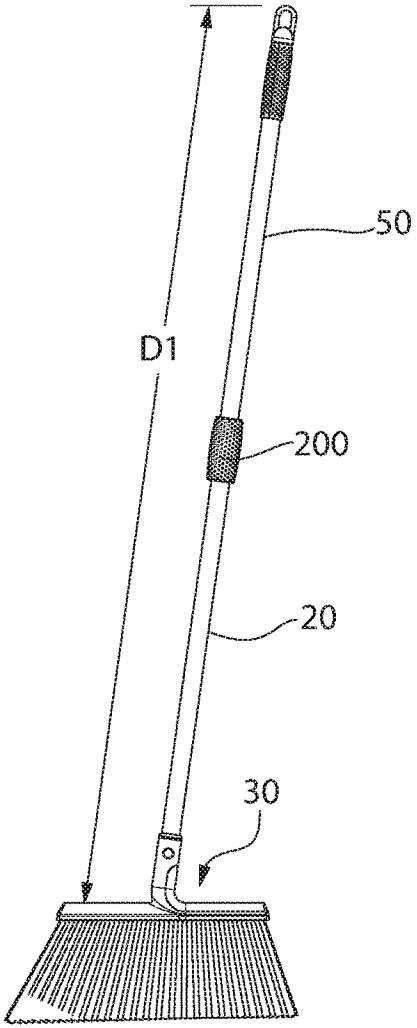
FIG. 12 shows the too handle in the unfolded and axially straight configuration or condition.

FIGS. 1, 3, and 12 illustrates an operational unfolded configuration or condition of the collapsible handle 10 for a broom having an implement 30 in the form of a broom head with brush comprising a plurality of bristles, or other long-handled tool. FIGS. 4 and 13 show the folded storage configuration or condition of the handle 10. The handle 10 in the collapsed configuration may be about half the length of the handle in the operational configuration in some embodiments.

Referring to FIGS. 1-4 and 12-24, in certain embodiments, lower handle member 20 may be mounted to implement 30 via a movable spring-loaded button or pin 40, or other fastening mechanism. Pin 40 may be formed on a living hinge integrally formed as a unitary structural portion of tool fastening fitting 41 fixedly mounted on distal end 22 of lower handle member 20 (see, e.g. FIG. 2), or other suitable fastening mechanism. In certain embodiments, the fastening fitting 41 may permit for the implement 30 to be removably attached from the handle 10, or it may be permanently affixed to the handle 10. Fitting 41 is inserted into a socket 42 formed in the rigid head frame 43 of the implement 30 (e.g. broom head). When the fastening fitting 41 is inserted fully into socket 42, the pin 40 projects laterally outward through and engages a complementary configured retention hole 44 in the implement frame 43 to lock the handle 10 to the implement. The pin 40 may be subsequently pushed inwards by the user to uncoupled the handle 10 from the implement.

The upper handle member 50 may include a terminal end cap 201 with optional loop for handling and storage of the tool 11. End cap may be tubular and elongated in one construction and is slideably received over proximal end 52 of the handle member 50.

FIGS. 15-24 show a sequential views of a method for operating tool 11 having the foldable elongated tool handle 10 discloses herein. These figures illustrate changing the tool handle 10 from the folded storage configuration or condition to the operational unfolded configuration or condition.

Figure 15:
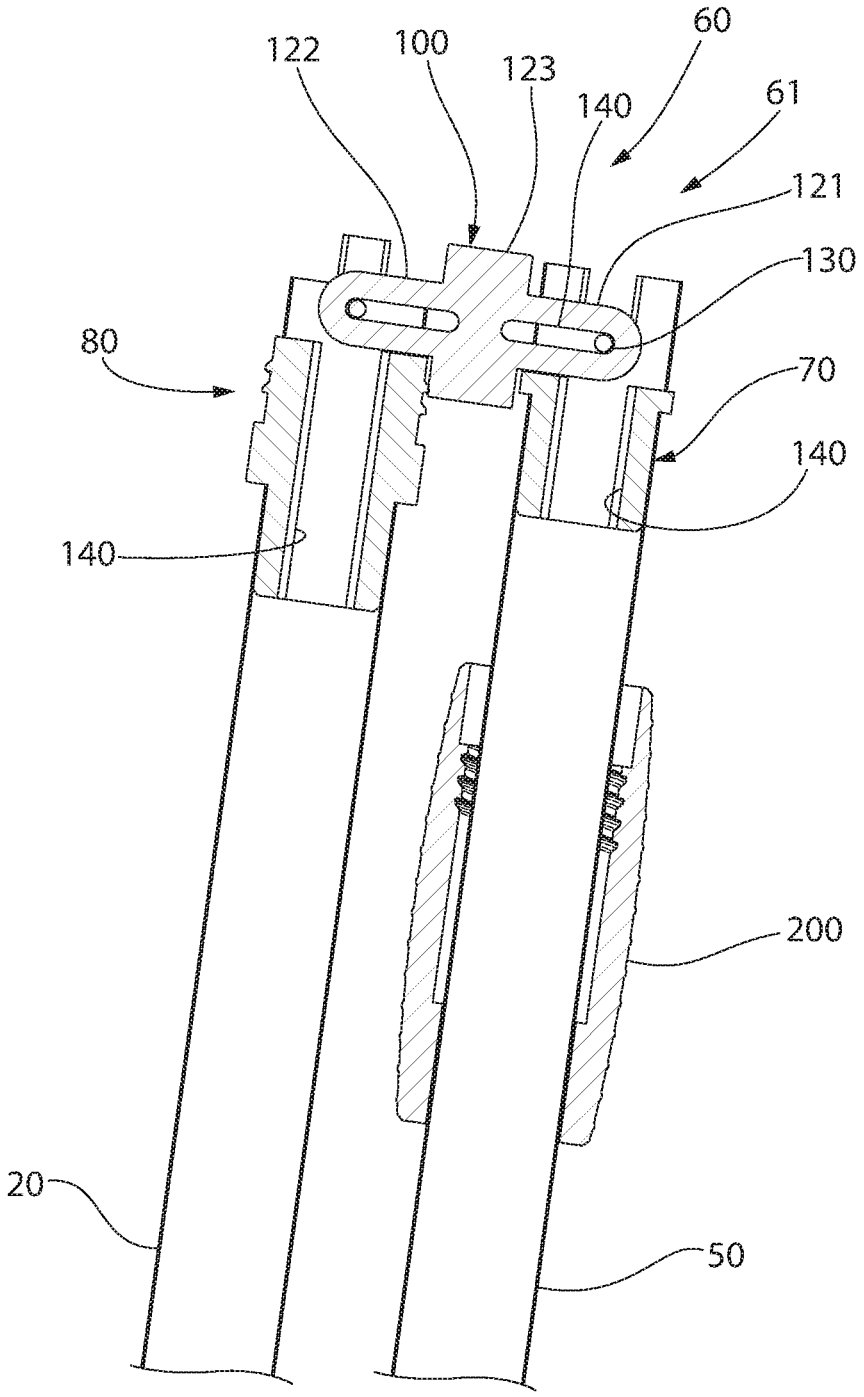
FIG. 15 is a side cross-sectional view of the tool handle in a first folded position.
Figure 16:
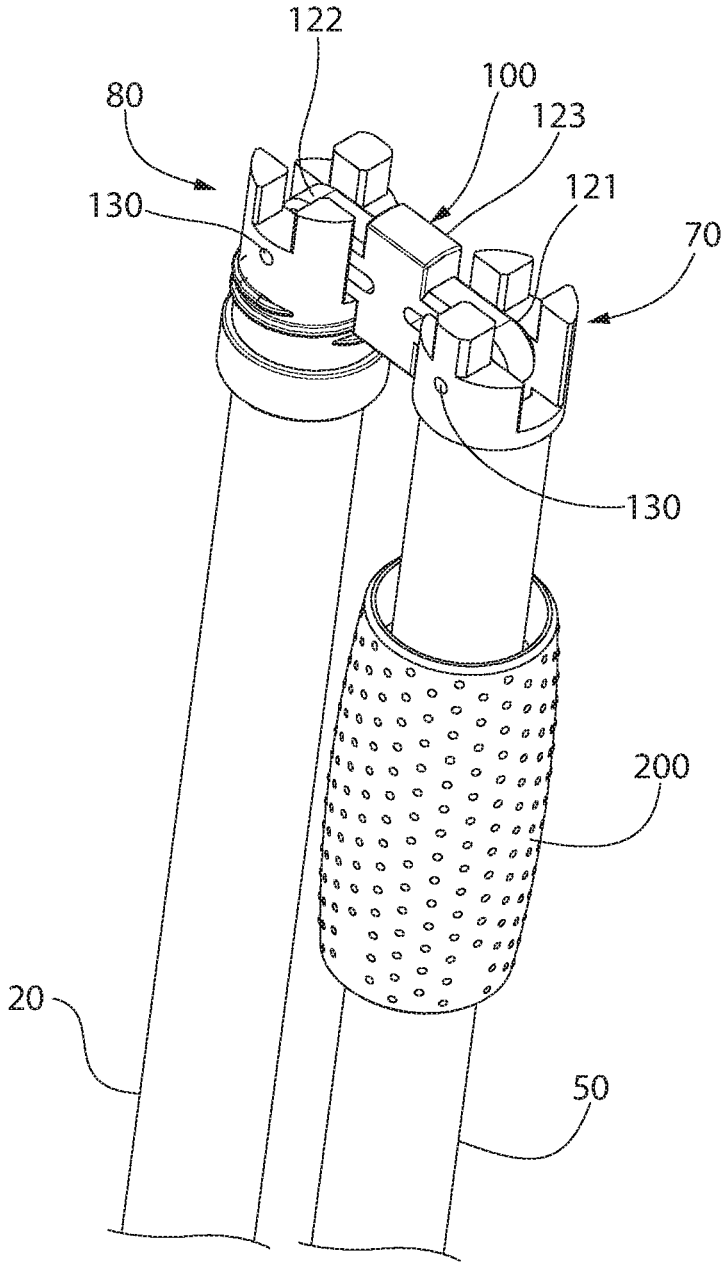
FIG. 16 is a perspective view thereof.

The steps of the method are summarized as follows. FIGS. 15 and 16 shown the tool handle 10 started in the folded configuration or condition described before. Upper handle member 50 is laterally offset from and adjacent to the lower handle member 20 in side-by-side relationship. Toggle linkage 100 spatially displaces the two handle members, which may be arranged substantially parallel to each other (recognizing that some angular deviation may existing in their relative positioning). The arm portions 121, 122 of the toggle linkage are locked in channels 113 of each coupler fitting 70, 80 to help maintain the position of the handle members (see also FIG. 7 for additional detail) Locking collar 200 is loosely retained on the upper handle member.

Figure 17:
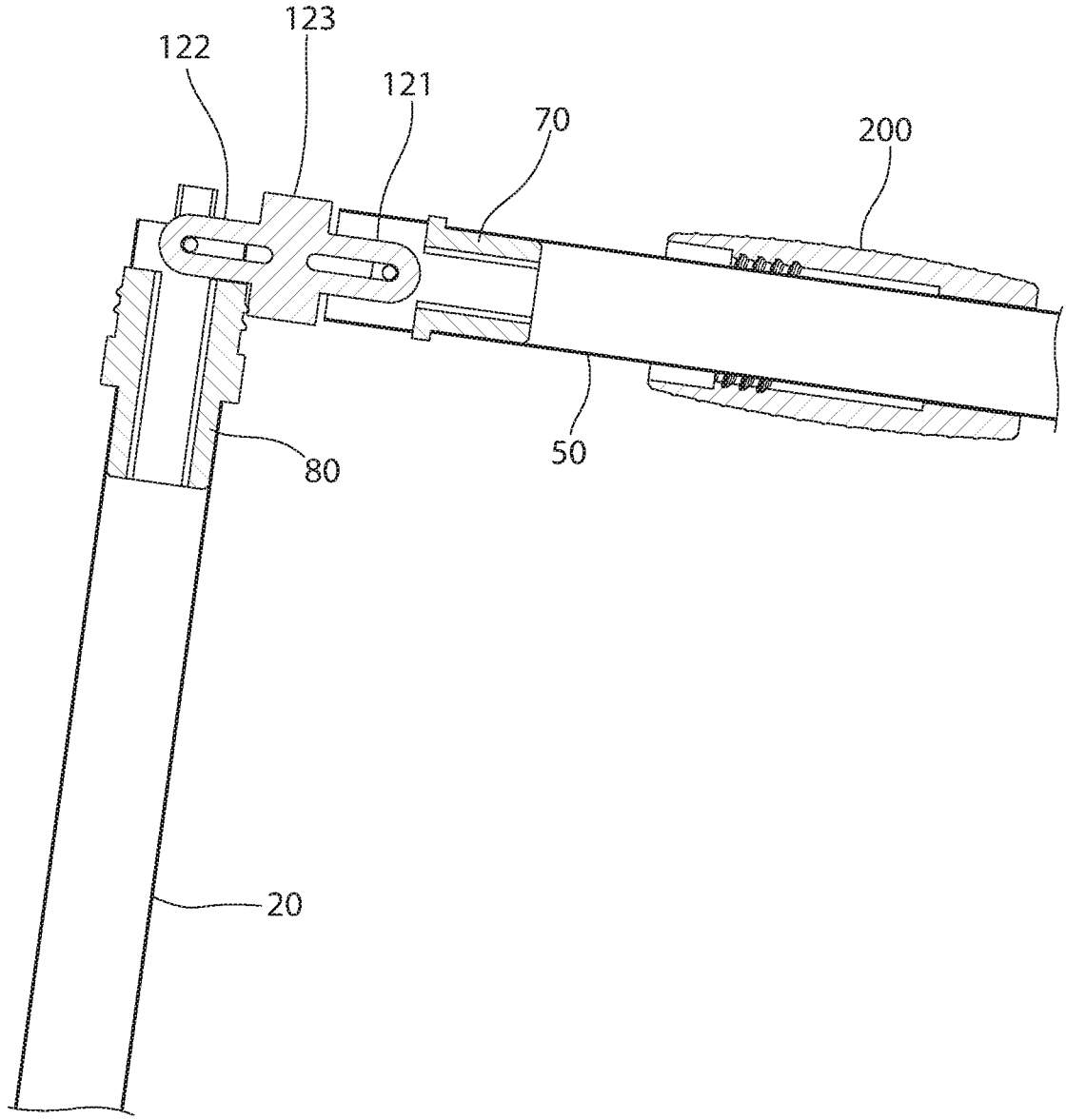
FIG. 17 is a side cross-sectional view of the tool handle in a second position.
Figure 18:
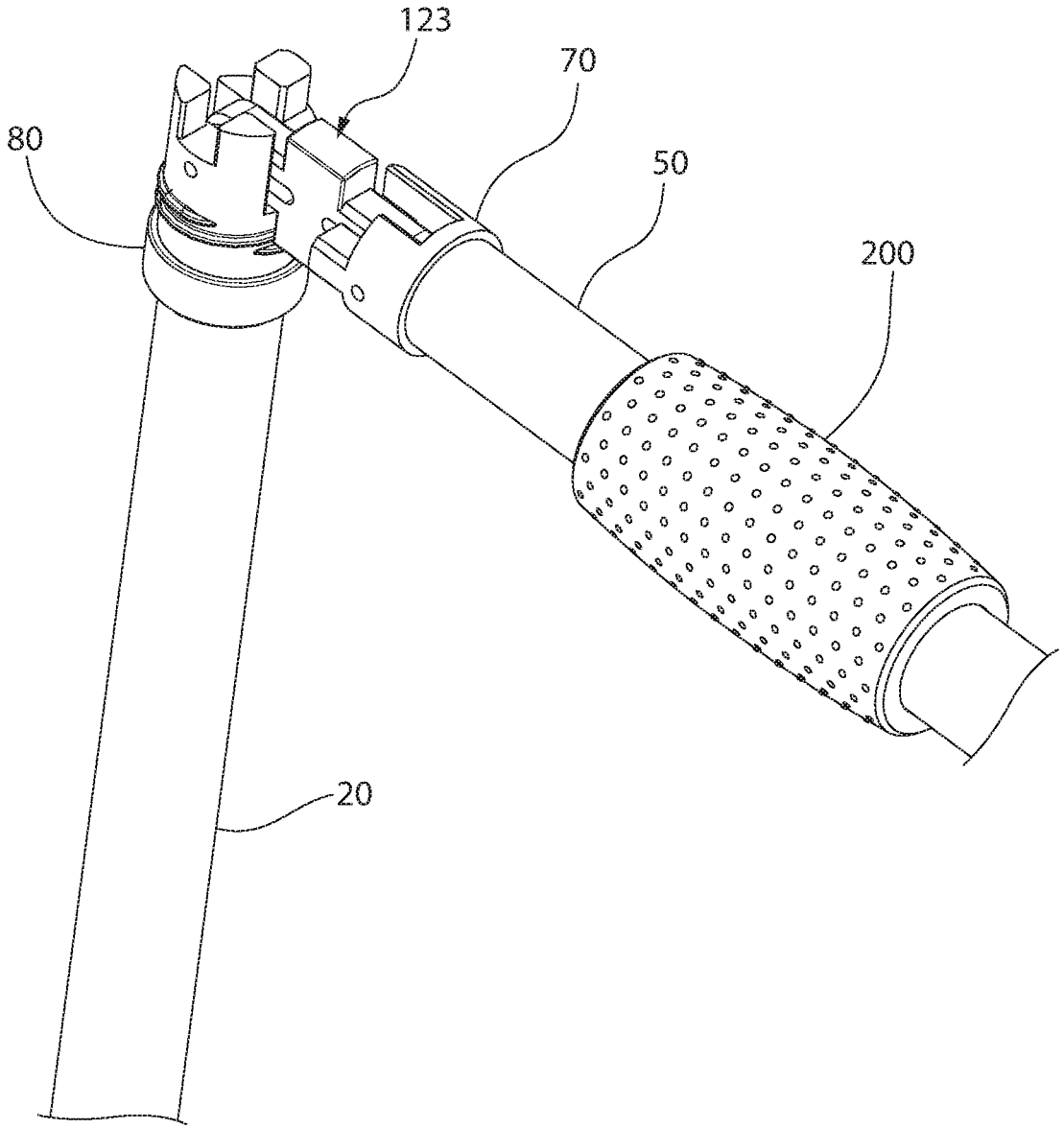
FIG. 18 is a perspective view thereof.
Figure 19:
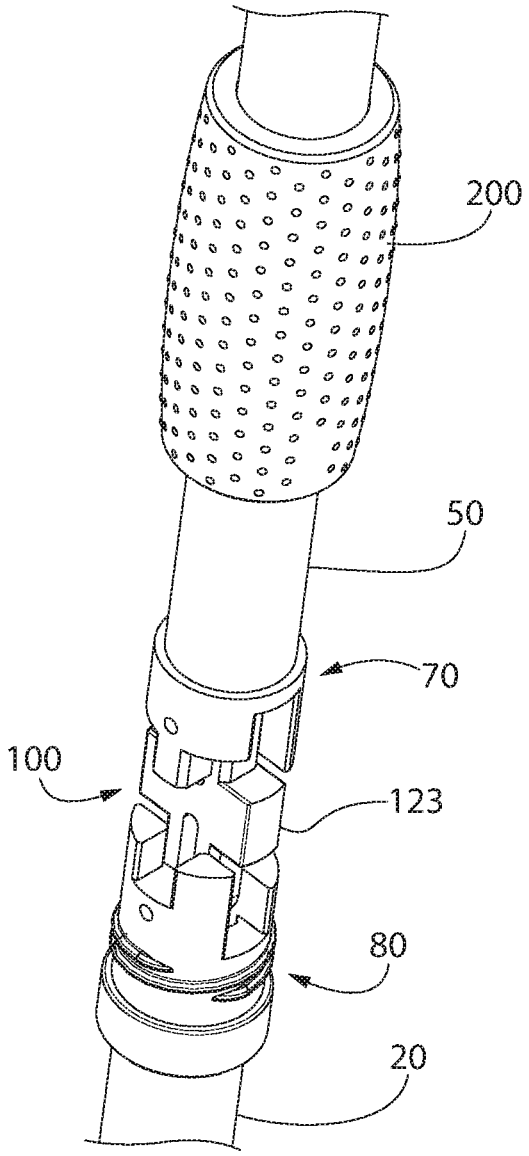
FIG. 19 is a perspective view of the tool handle in a third position.
Figure 20:
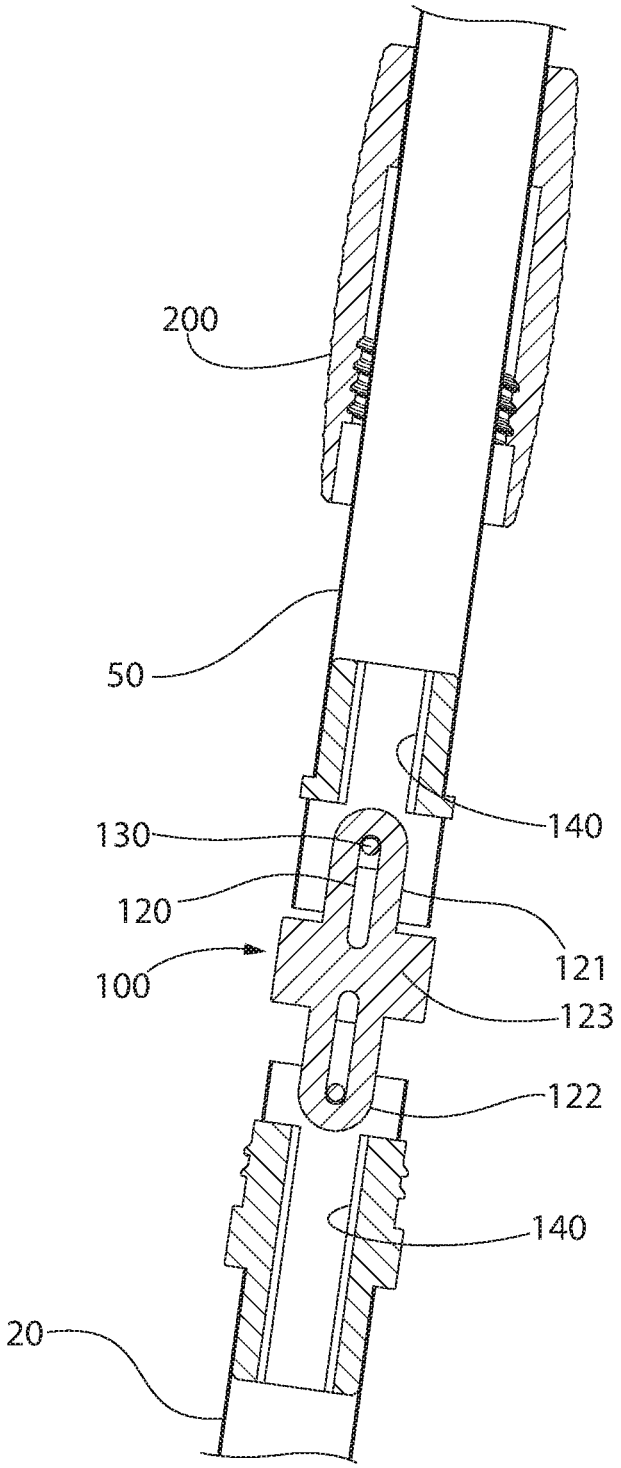
FIG. 20 is a side cross-sectional view thereof.

In FIGS. 17 and 18, the upper handle member 50 is rotated upwards by the user about coupler fitting 80 of the lower handle member 20. The upper handle member may rotate about its pivot pin 130 and toggle linkage slot 140 assembly and/or the same pivot assembly on the lower handle member. Due to the double-jointed hinge mechanism 60, any of these motions is possible. In these figures, arm portion 121 of the toggle linkage 100 may become axially aligned with it mating locking passage 140 of the upper coupler fitting 70 as shown. This alignment can be produced later in the sequence in other embodiment and does not affect the process of coupling the upper handle member to the lower handle member.

The upper handle member 50 continues to be rotated upwards until it is coaxially aligned with the lower handle member 20 and the longitudinal axis LA of the handle 10 (see also FIGS. 5-6 and 9-11). The toggle linkage 100 and its arm portions 121, 122 are axially aligned with the longitudinal axis and handle members.

Figure 21:
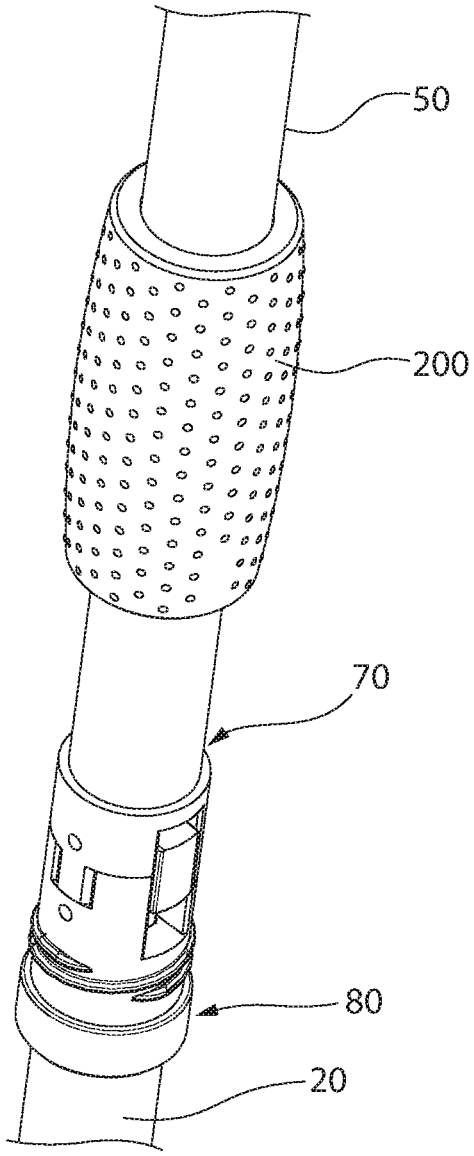
FIG. 21 is a perspective view of the tool handle in a fourth position.
Figure 22:
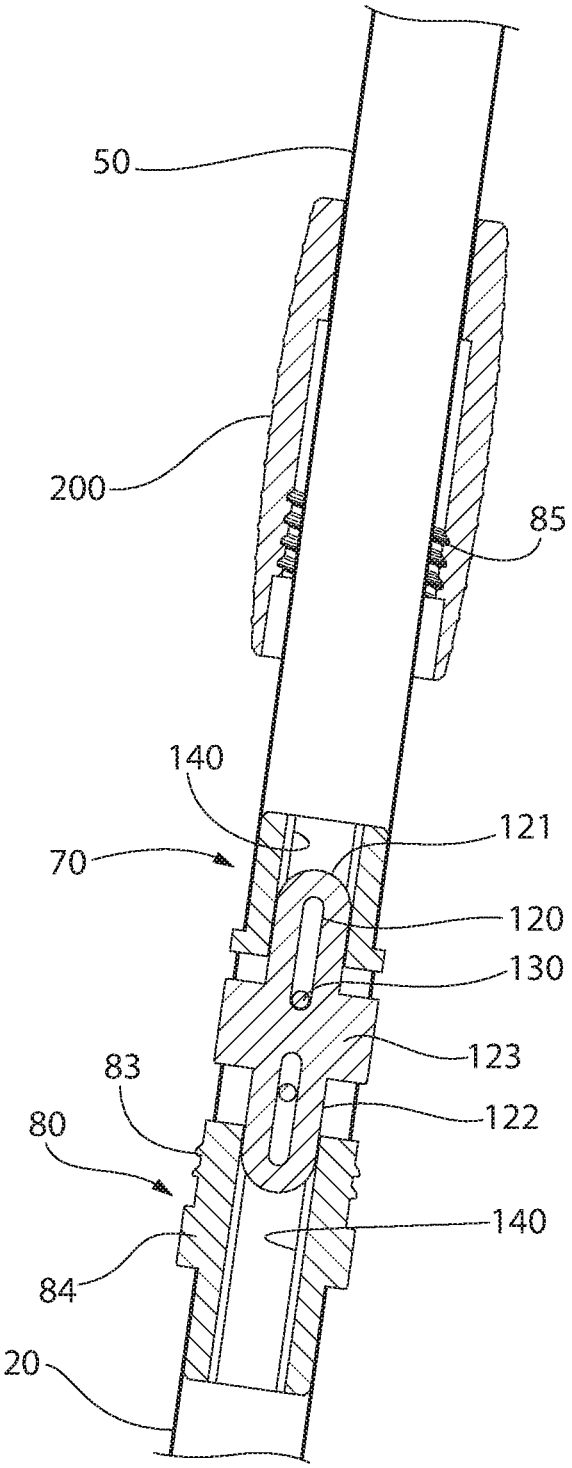
FIG. 22 is a side cross-sectional view thereof.

With the axial alignment achieved, the upper handle member 50 is advanced and pushed towards the lower handle member 20 as shown in FIGS. 21 and 22. Each arm portions 121, 122 is initially slideably inserted into and frictionally engages its respective axially aligned elongated locking passage 130 as shown during this motion.

Figure 23:
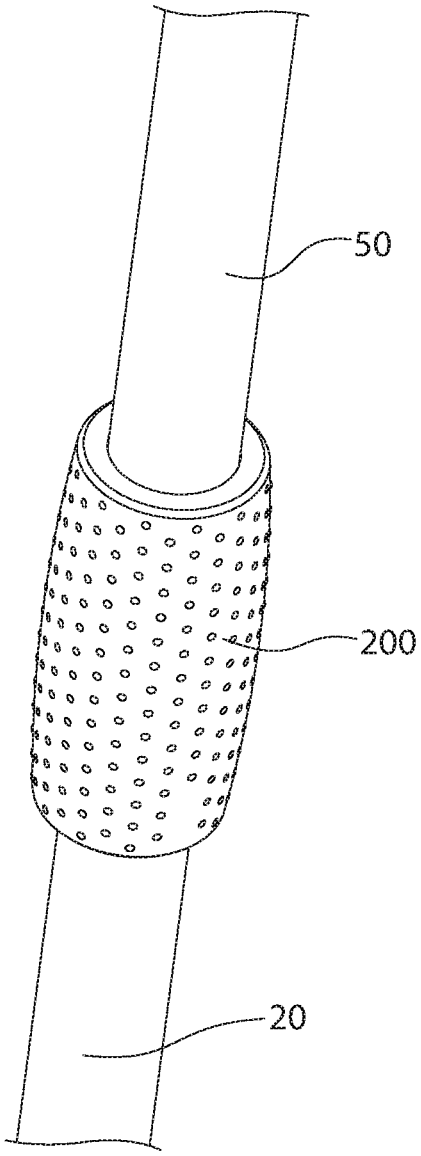
FIG. 23 is a perspective view of the tool handle in a fifth position.
Figure 24:
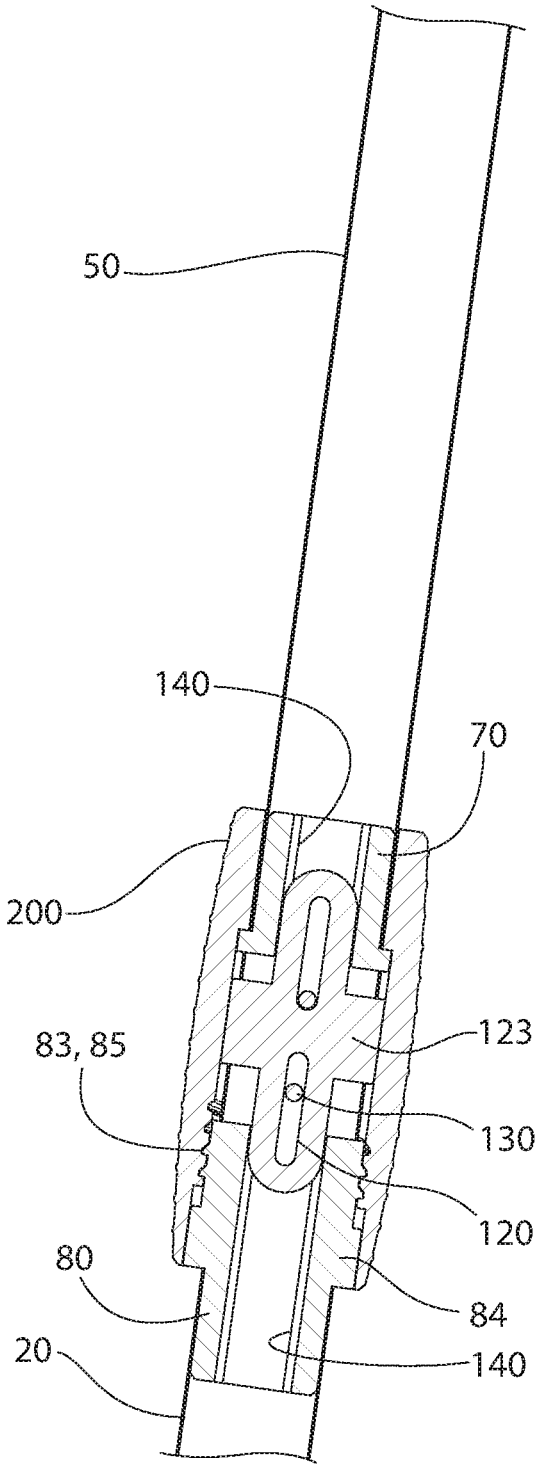
FIG. 24 is a side cross-sectional view thereof.
Figure 26:
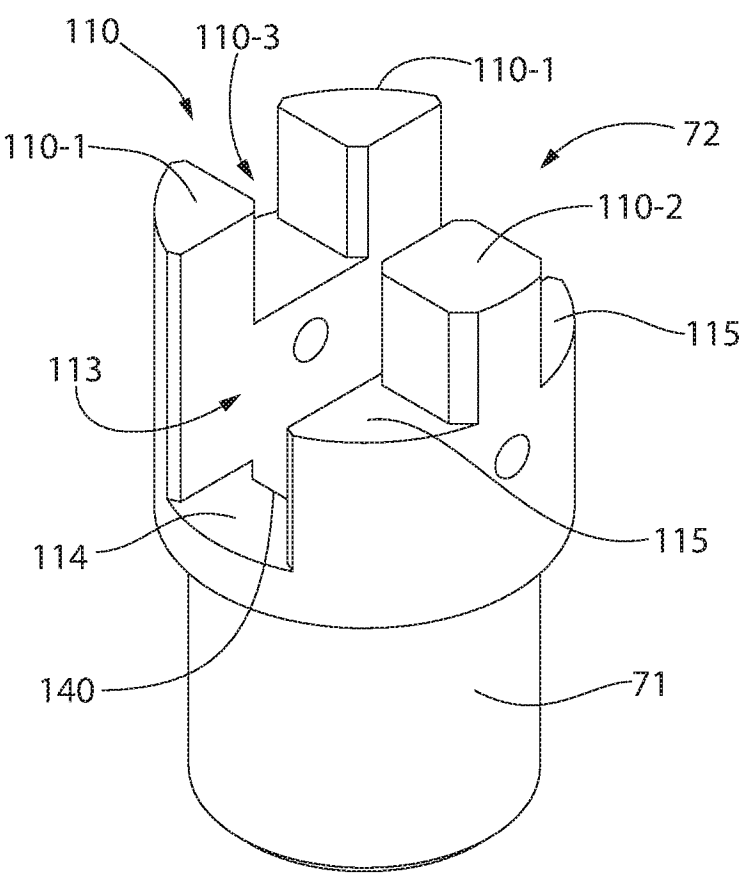
FIG. 26 is a second perspective view thereof.
Figure 25:
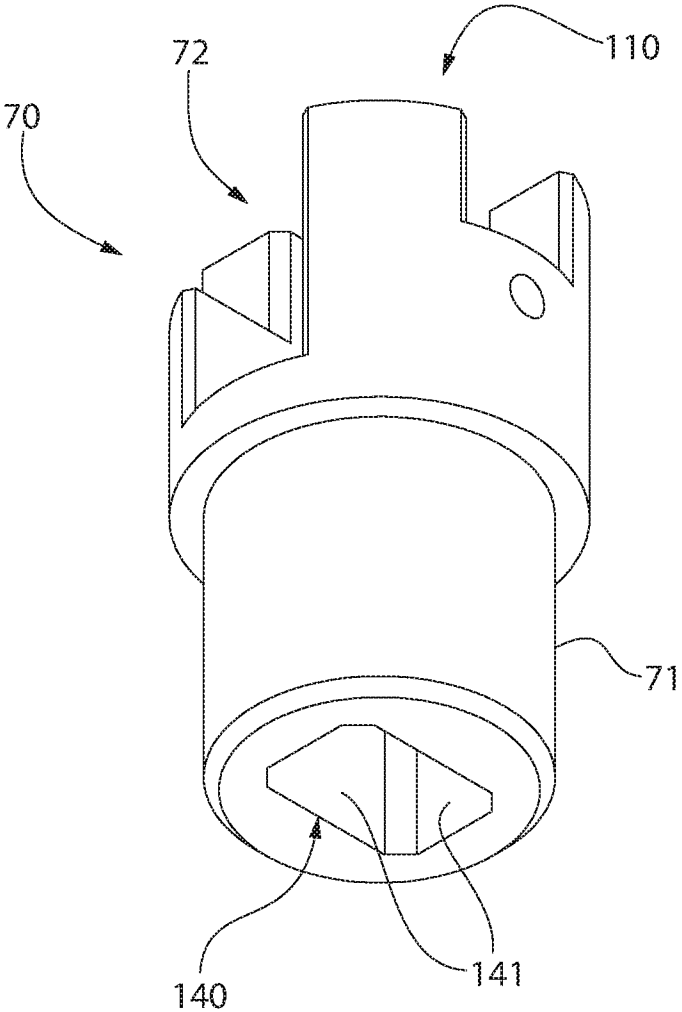
FIG. 25 is a first perspective view of the upper coupler fitting of the tool handle of FIG. 1.
Figure 28:
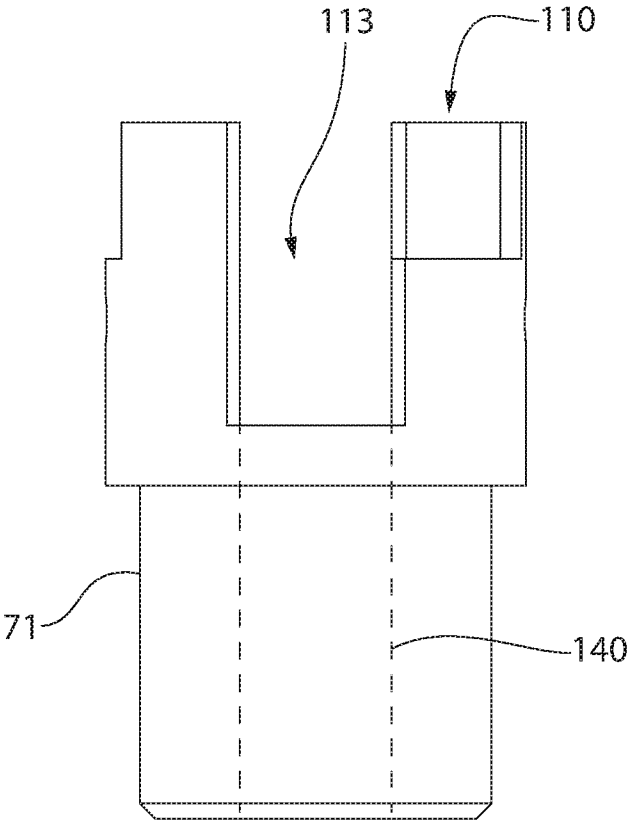
FIG. 28 is a second side view thereof.
Figure 27:
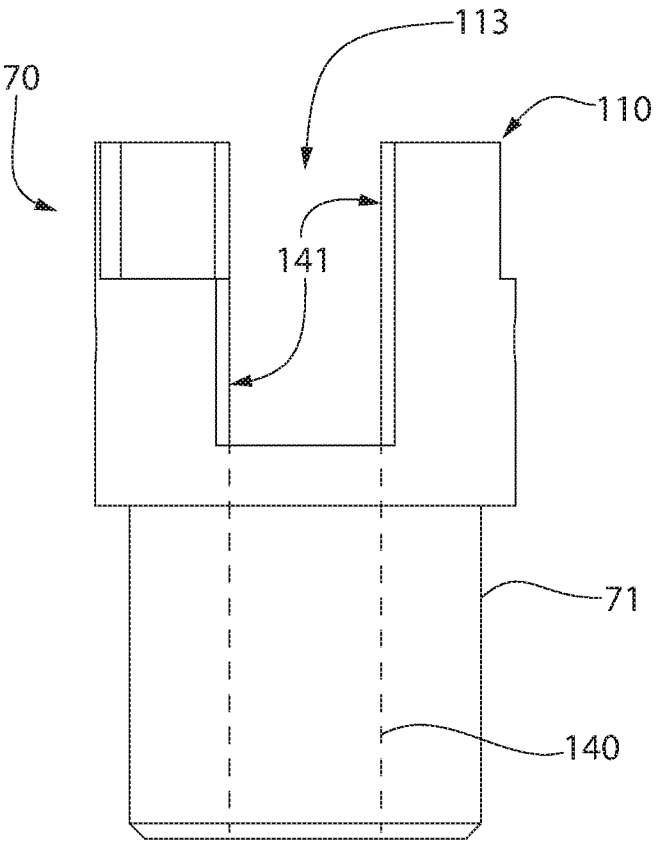
FIG. 27 is first side view thereof.
Figure 30:
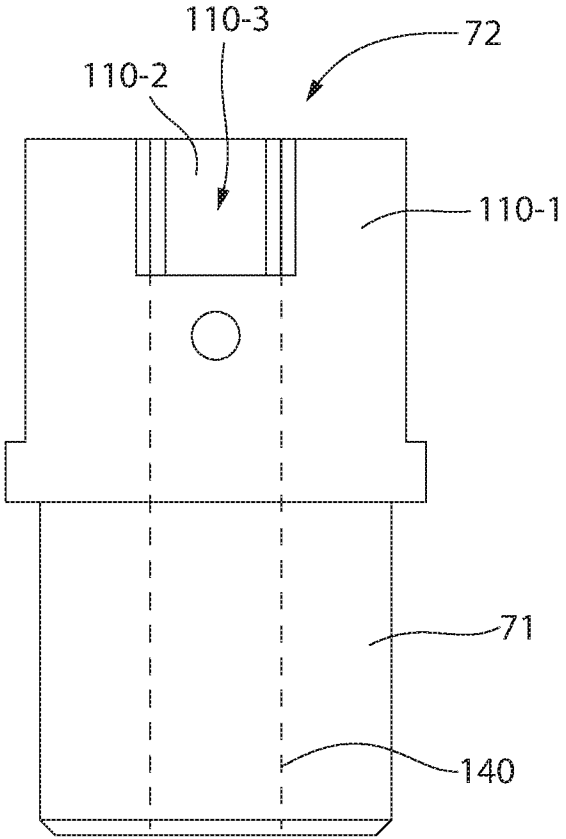
FIG. 30 is a fourth side view thereof.
Figure 29:
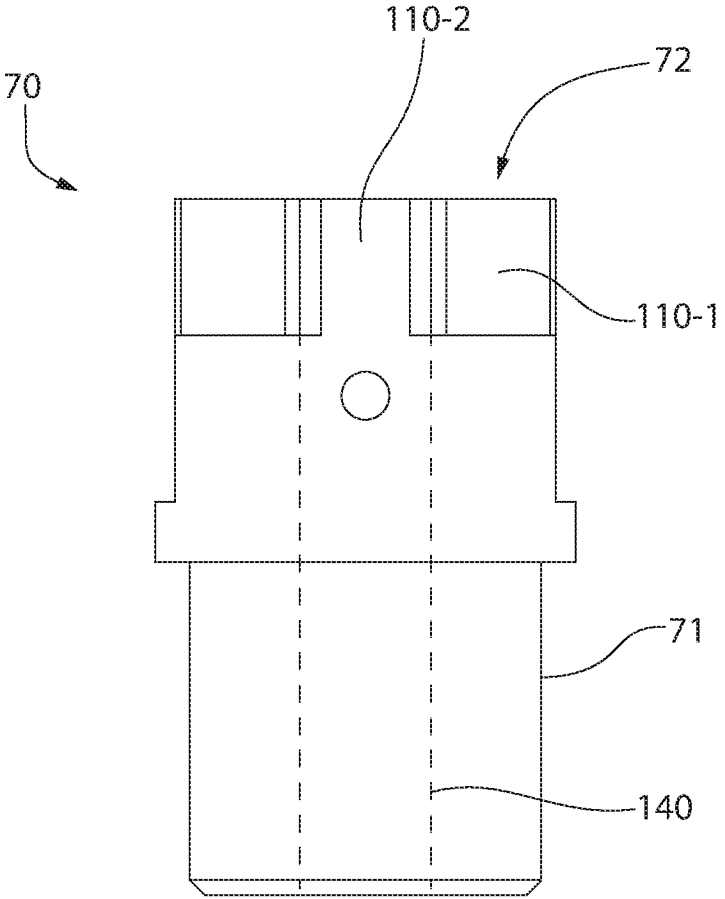
FIG. 29 is a third side view thereof.
Figure 32:
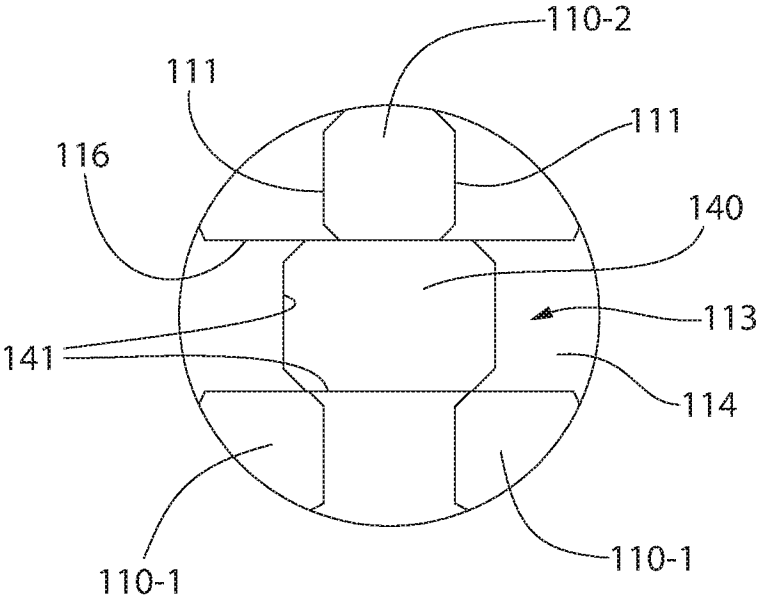
FIG. 32 is a top view thereof.
Figure 31:
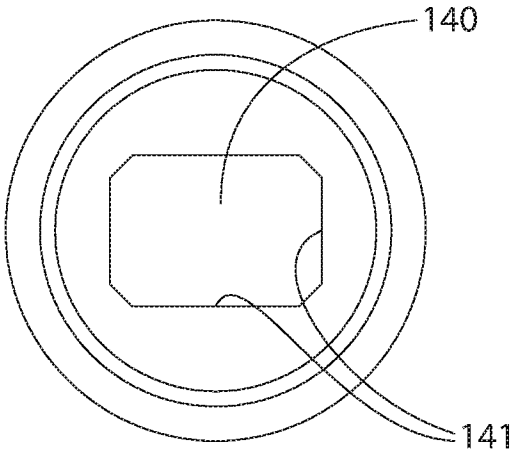
FIG. 31 is a bottom view thereof.
Figure 34:
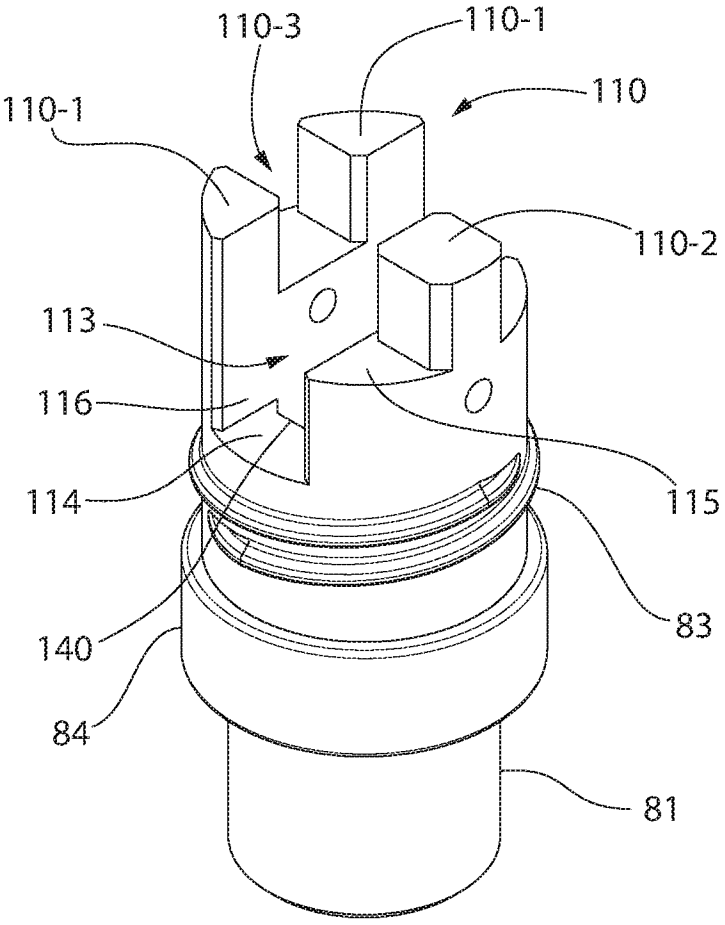
FIG. 34 is a second perspective view thereof.
Figure 33:
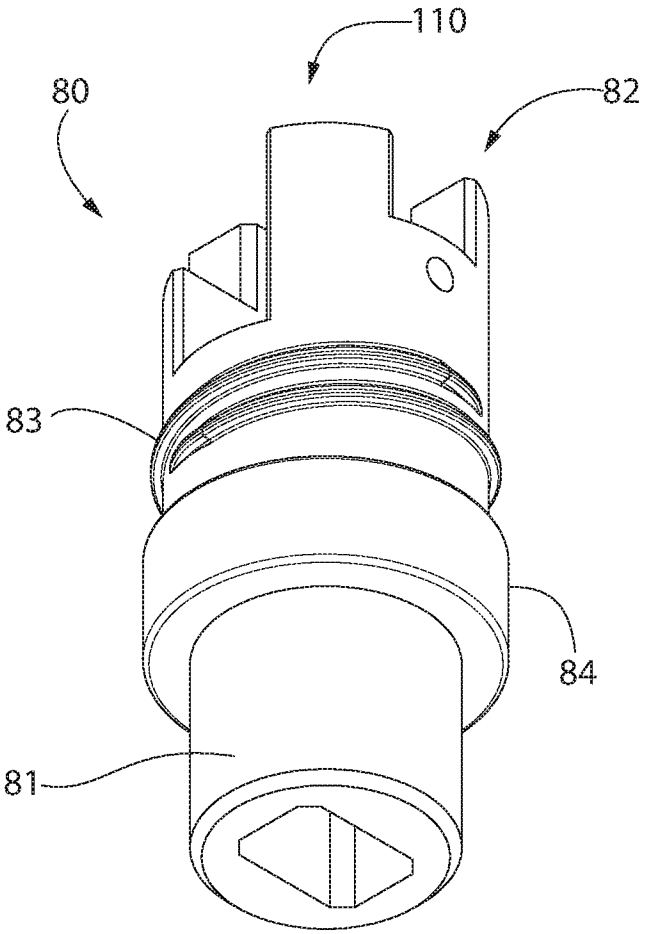
FIG. 33 is a first perspective view of the lower coupler fitting of the tool handle of FIG. 1.
Figure 36:
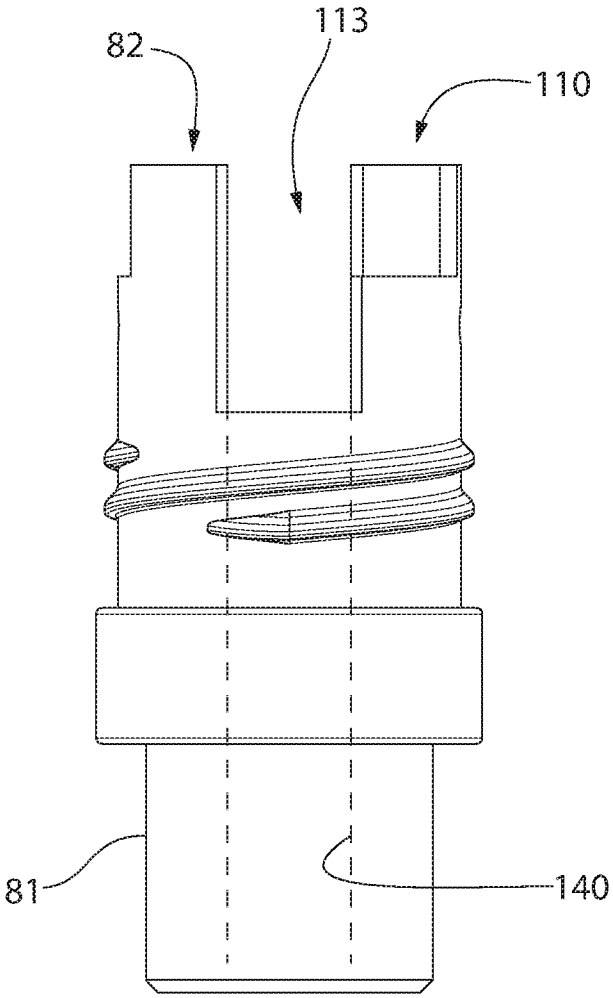
FIG. 36 is a second side view thereof.
Figure 35:
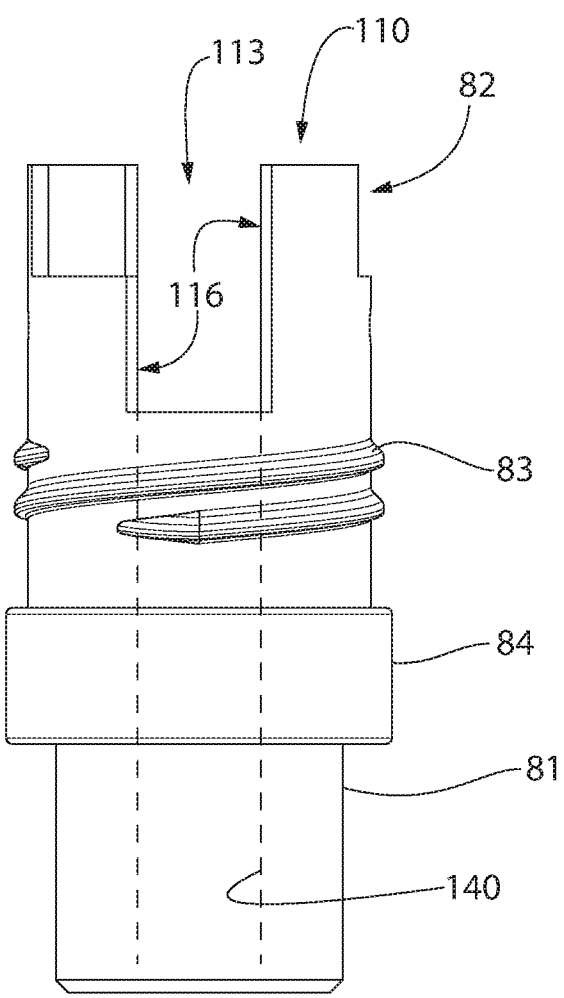
FIG. 35 is first side view thereof.
Figure 38:
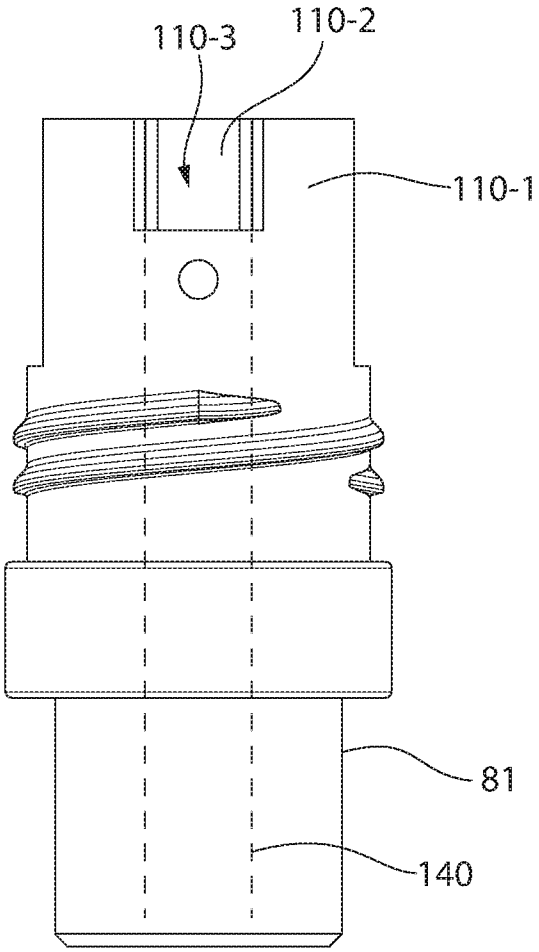
FIG. 38 is a fourth side view thereof.
Figure 37:
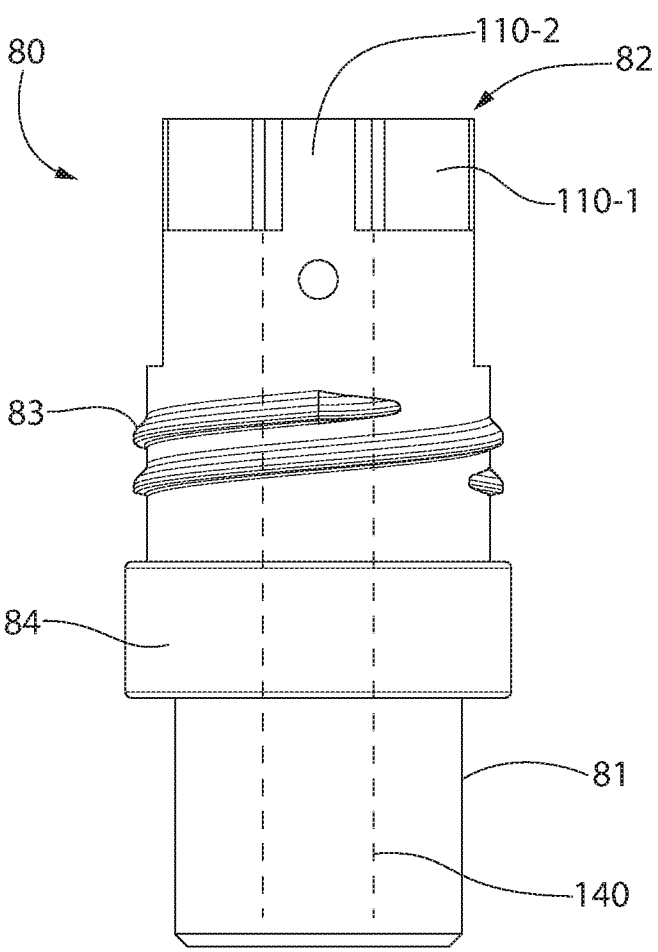
FIG. 37 is a third side view thereof.
Figure 40:
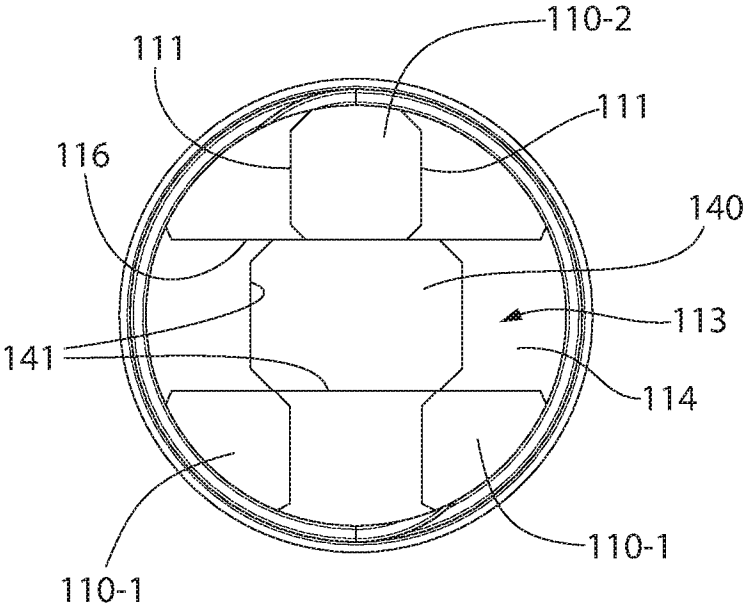
FIG. 40 is a top view thereof.
Figure 39:
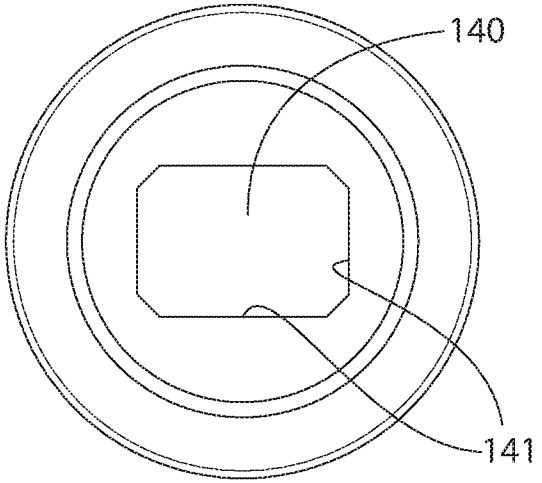
FIG. 39 is a bottom view thereof.
Figure 41:
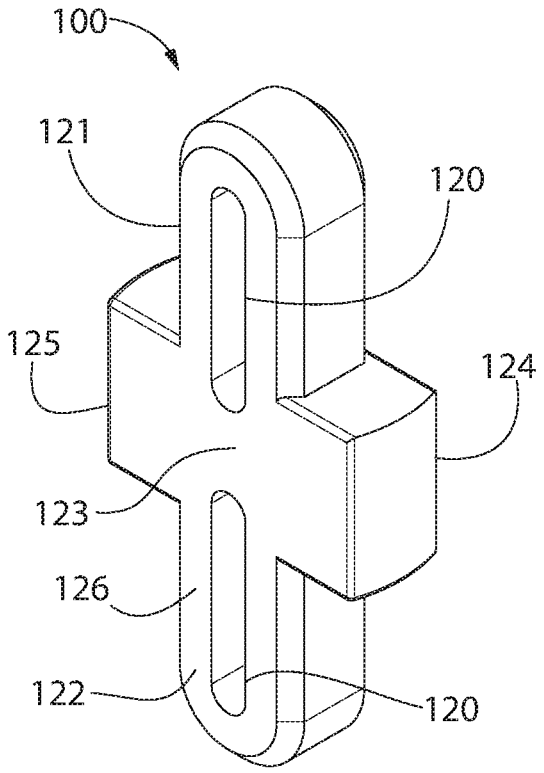
FIG. 41 is a perspective view of the toggle linkage of the tool handle of FIG. 1.
Figure 42:
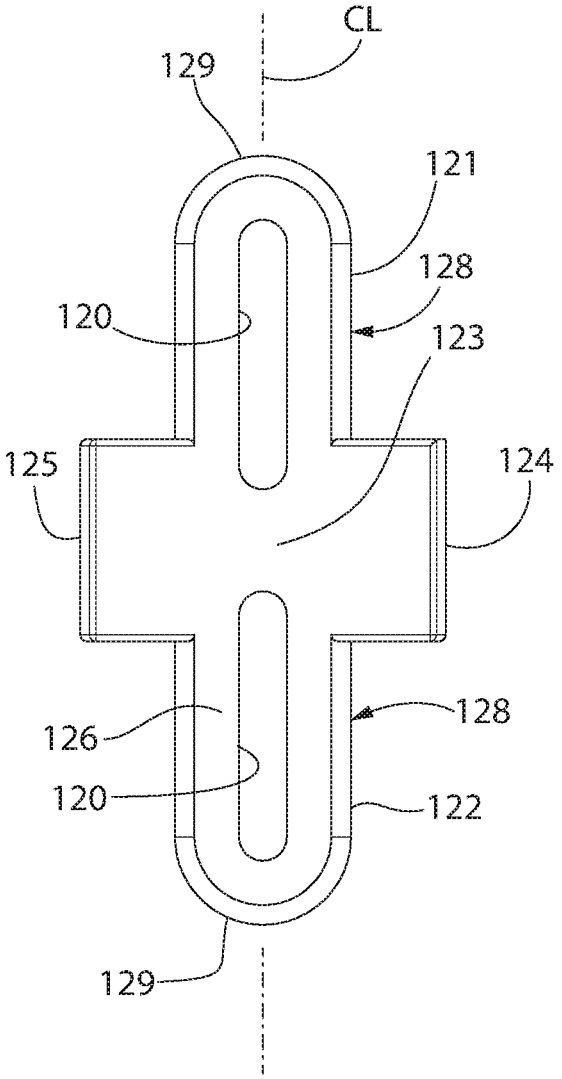
FIG. 42 is front view thereof.
Figure 43:
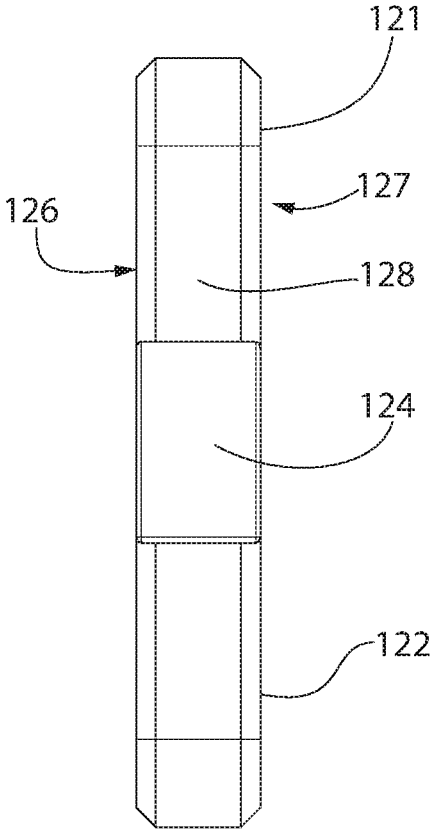
FIG. 43 is a side view thereof.
Figure 44:
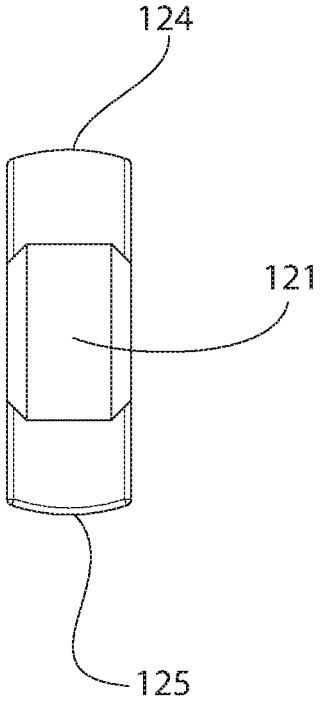
FIG. 44 is a top view thereof.

In the penultimate step of the method or process, the upper handle member 50 is pushed further towards the lower handle member 20 until the upper and lower coupler fittings 70, 80 are fully engaged as shown in FIGS. 23 and 24. The arm portions 121, 122 of toggle linkage 100 are inserted and positioned into further engagement with their respective locking passages of coupler fittings 70, 80. The axial protrusions 110 of upper fitting 70 are fully nested and engaged with the axial protrusions 110 of lower fitting 80, thereby forming an interlocked arrangement or relationship which is resistant to twisting or torsional forces acting about the longitudinal axis LA at the hinged joint 61 when the tool is used. The block-shaped central or middle portion 123 of cruciform shaped toggle linkage 100 is inserted into the lateral locking channel 113 of the upper and lower coupler fittings 70, 80. The foregoing forms three of the locking features of the hinged joint 61.

Once the coupler fittings 70, 80 are fully engaged as described above, the final step of securing the double-jointed hinged joint 61 involves sliding the locking collar 200 over the joint and threading the collar onto lower coupler fitting 80. The collar is rotated until the threaded engagement is fully tightened to releasably lock the collar onto the join. During the process, the inward facing annular surfaces inside collar 200 frictionally engage the frustoconical annular flange 84 of the lower coupler fitting 80 to further secure the engagement. The upper handle member 50 is now fully locked to the lower handle member 20, and the tool 11 is ready for use.

It bears noting that the tool handle 10 may be converted back to the folded configuration or condition after use by simply reversing the foregoing steps.

FIG. 12 shows the tool handle 10 in the straight operational and unfolded configuration or condition having an axial length D1 measured from the top of upper handle member 50 to the head frame 43 of the implement 30. FIG. 13 shows the tool handle 10 in the folded configuration or condition for storage and packaging having an axial length D2 measured from the top of the articulated joint 61 which is less than D1. D2 is about one half D1 in this example; however, in other examples D2 may be greater or less than one half D1.

In some embodiments, more than one joint 61 and hinge mechanism 60 may be used to produce an even shorter and more compact folded configuration of the handle 10 for storage, packaging, and/or shipping. It will further be evident by analogy that the unique double-jointed articulated joint 61 may be used with tool handles that are longer than a typical broom or mop handle disclosed herein by using multiple joints 61. These additional joints 61 may be spaced apart on the long handle at intervals selected to achieve the final collapsed and folded height of the handle desired. One non-limiting example of such a long-handled tool is a commercial light bulb changer pole which may be about 11 feet or more in total assembled length. This contrasts to a typical broom or mop handle which be about 3.5 to 4 feet in length. Accordingly, the present invention is not limited to use of a single hinge joint.

In addition to mops, broom, rakes, lightbulb changing poles, pole pruners, snow shovels, and similar indoor/outdoor maintenance tools, the present invention may be used with a wide and virtually unlimited variety and types of tools that may benefit from a collapsible and foldable tool handle having a sturdy and rotationally resistant hinged joint construction having multiple interlocking features. Some non-limiting examples include construction or camping tools such as shovels. Accordingly, the present invention is expressly not limited for use with any particular type of implement attached to a jointed handle.

Any appropriate materials may be used for fabricating the jointed long-handled tool components described herein. As some non-limiting examples, the upper and lower handle member 20, 50 may be formed of metal or alternatively a suitable rigid polymer. The coupler fittings 70, 80, toggle linkage 100, and hinge collar 200 may be formed of injection molded rigid polymers. The pins used if any preferably may be metal. Rigid polymers and/or semi-rigid elastomeric polymers may be used for the handle end cap 201 and frame of the implement 30. Other suitable materials may be used and does limit the invention.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A foldable elongated tool handle for compact storage of a tool, the handle comprising:

a longitudinal axis;

an elongated first handle member comprising a terminal end configured for coupling to a tool, and a coupling end;

an elongated second handle member comprising a coupling end;

the coupling ends of the first and second handle members hingedly coupled together at a first articulated joint via an elongated toggle linkage;

the toggle linkage having a rigid body comprising a first arm portion opposite a second arm portion, and a central middle portion therebetween;

the first arm portion of the toggle linkage slideably insertable into a first central axial passage in the coupling end of the first handle member, and the second arm portion of the toggle slideably insertable into a second central axial passage in the coupling end of the second handle member;

the handle changeable via operation of the toggle linkage between (i) an unfolded condition in which the first and second handle members are coaxially aligned with the longitudinal axis, and (ii) a folded condition in which the second handle member is laterally offset from the longitudinal axis in side-by-side relationship to the first handle member;

wherein the first and second arm portions of the toggle linkage are inserted and lockably engaged in the first and second central axial passages respectively when the handle is in the unfolded condition to prevent twisting of the toggle linkage about the longitudinal axis relative to the first and second handle members which are held in coaxial alignment by the toggle linkage;

wherein when the handle is in the folded condition, the first and second arm portions of the toggle linkage are removed from the first and second central axial passages in the first and second coupling ends of the first and second handle members, respectively; and a locking collar slideably movable along the second handle member to cover the joint, the locking collar configured to threadably engage the first handle member for locking the handle in the unfolded condition.

2. The tool handle according to claim 1, wherein the first and second central axial passages and the first and second arm portions have complementary configured transverse cross-sectional shapes which prevent twisting of the toggle linkage relative to the first and second coupling ends of the first and second handle members.

3. The tool handle according to claim 2, wherein the first central axial passage and the first arm portion of the toggle linkage have a rectilinear cross-sectional shape, and the second central axial passage and the second arm portion of the toggle linkage have a rectilinear cross-sectional shape.

4. The tool handle according to claim 1, wherein the first and second central axial passages each have an axial length at least equal to or greater than an axial length of their respective first and second arm portions of the toggle linkage.

5. The tool handle according to claim 1, wherein the toggle linkage is pivotably movable transversely to the longitudinal axis and relative to the first and second handle members when the first and second arm portions are removed from their respective first and second central axial passages.

6. The tool handle according to claim 1, wherein the first arm portion of the toggle linkage is pivotably coupled to the first handle member via a first pivot pin and first slot assembly, and the second arm portion of the toggle linkage is pivotably coupled to the second handle member via a second pin and second slot assembly.

7. The tool handle according to claim 6, wherein:

the first pin and slot arrangement assembly comprises the first pivot pin being fixedly mounted at the coupling end of the first handle member and the first slot is formed in the first arm portion of the toggle linkage; and the second pin and slot arrangement assembly comprises the second pivot pin being fixedly mounted at the coupling end of the second handle member and the second slot is formed in the first arm portion of the toggle linkage;

wherein the first handle member is pivotably movable about the first pivot pin independently of the second handle member which is pivotably movable about the second pivot pin.

8. The tool handle according to claim 7, wherein the toggle linkage is pivotably movable into a horizontal position transversely oriented to the longitudinal axis when the tool handle is in the folded condition.

9. The tool handle according to claim 1, wherein the first and second central axial passages are each defined in a first and second coupler fitting rigidly mounted to the coupling ends of the first and second handle members, respectively.

10. The tool handle according to claim 9, wherein the toggle linkage has a cruciform shaped body comprising the middle portion of the toggle linkage being block-shaped and transversely elongated relative to the first and second arm portions.

11. The tool handle according to claim 10, wherein the block-shaped middle portion lockably engages a transversely oriented locking channel formed in each of the first and second coupler fittings when the handle is in the unfolded condition.

12. The tool handle according to claim 9, wherein each of the first and second coupler fittings include a plurality of axial protrusions that extend axially parallel to the longitudinal axis, the axial protrusions of the first coupler fitting configured to form an interlocked arrangement with the axial protrusions of the second fitting to rotationally lock the first handle member relative to the second handle member when the handle is in the unfolded condition.

13. The tool handle according to claim 1, wherein the tool is a broom head.

14. The tool handle according to claim 1, wherein the first and second handle members have a hollow tubular body.

15. A foldable tool handle with articulating joint comprising:

a longitudinal axis;

an elongated first handle member comprising first and second ends;

an elongated second handle member comprising first and second ends;

the first handle member hingedly coupled to the second handle member by a double-jointed articulating joint;

the articulating joint comprising a first coupler fitting attached to the first end of the first handle section, a second coupler fitting attached to the first end of the second handle section, and a toggle linkage;

the toggle linkage comprising an elongated body including a first arm portion opposite a second arm portion, and a central middle portion located therebetween;

the toggle linkage pivotably coupled to: (i) the first coupler fitting via a first pivot pin slideably received in an elongated slot of the first arm portion, and (ii) the second coupler fitting via second pivot pin slideably received in an elongated slot of the second arm portion;

the handle changeable via operation of the toggle linkage between (i) an unfolded condition in which the first and second handle members are coaxially aligned with the longitudinal axis, and (ii) a folded condition in which the second handle member is laterally offset from the longitudinal axis in side-by-side relationship to the first handle member via sliding the pivot pins in their respective slots;

wherein the toggle linkage has a cruciform configuration, the middle portion of the toggle linkage being rectilinear block-shaped and comprising a first locking block protrusion extending outwards in a first direction transversely to the first and second arm portions, and a second locking block protrusion extending outwards in an opposite second direction transversely to the first and second arm portions.

16. The tool handle according to claim 15, wherein each of the first and second coupler fittings include a plurality of axial protrusions that extend axially parallel to the longitudinal axis, the axial protrusions of the first coupler fitting configured to form an interlocked arrangement with the axial protrusions of the second fitting to rotationally lock the first handle member relative to the second handle member when the handle is in the unfolded condition.

17. The tool handle according to claim 15, wherein the block-shaped middle portion lockably engages a transversely oriented locking channel formed in each of the first and second coupler fittings when the handle is in the unfolded condition.

18. The tool handle according to claim 17, wherein the first and second arm portions of the toggle linkage are inserted and lockably engaged in the first and second central axial passages formed in the first and second coupler fittings respectively when the handle is in the unfolded condition, the first and second arm portions and their respective first and second central passages each having rectilinear cross-sectional shape which prevents twisting of the toggle linkage about the longitudinal axis relative to the first and second handle members which are held in coaxial alignment by the toggle linkage.

19. The tool handle according to claim 18, further comprising a locking collar slideably movable along the second handle member to cover the joint, the locking collar configured to threadably engage the first handle member for locking the handle in the unfolded condition.

20. A method for operating a tool having a foldable elongated tool handle, the method comprising:

providing a tool handle comprising an elongated first handle member in a folded configuration axially offset from a second handle member, the handle members hingedly coupled together at a coupling end of each of the handle members by a toggle linkage, the toggle linkage pivotably coupled to the first handle member via a first pivot pin, and the toggle linkage pivotably coupled to the second handle member via a second pivot pin forming a double-jointed articulating joint;

wherein the toggle linkage has a cruciform configuration, the middle portion of the toggle linkage being rectilinear block-shaped and comprising a first locking block protrusion extending outwards in a first direction transversely to the first and second arm portions, and a second locking block protrusion extending outwards in an opposite second direction transversely to the first and second arm portions;

rotating the first handle member about the joint into coaxial alignment to the second handle member;

inserting a first arm portion of the toggle linkage into a first axial passage of the coupling end of the first handle member, the first arm portion having a rectilinear cross-sectional shape which locking engages a complementary configured cross-sectional shape of the first axial passage;

inserting a second arm portion of the toggle linkage into a second axial passage of the coupling end of the second handle member, the second arm portion having a rectilinear cross-sectional shape which locking engages a complementary configured cross-sectional shape of the second axial passage;

inserting a first plurality of axial protrusions at the coupling end of the first handle member between a second plurality of axial protrusion at the coupling end of the second handle member to form an interlocked arrangement; and lockably engaging the block-shaped middle portion of the toggle linkage with a transversely oriented locking channel formed in each of the coupling ends of the handle members;

wherein the first handle member coupled to the second handle member in coaxial alignment defines an unfolded configuration.

21. The method according to claim 20, further comprising sliding a tubular locking collar over the joint, and threadably engaging the locking collar with the coupling end of the first handle member.

* * * * *